US008794139B2

(12) United States Patent
Keith et al.

(10) Patent No.: US 8,794,139 B2
(45) Date of Patent: Aug. 5, 2014

(54) PRINTING APPARATUS

(75) Inventors: Daniel J. Keith, Pittsford, VT (US); Carl A. Maxham, Pittsford, VT (US)

(73) Assignee: The Graphic Edge, Inc., Carroll, IA (US)

( * ) Notice: Subject to any disclaimer, the term of this patent is extended or adjusted under 35 U.S.C. 154(b) by 80 days.

(21) Appl. No.: 12/382,131

(22) Filed: Mar. 9, 2009

(65) Prior Publication Data

US 2009/0223391 A1 Sep. 10, 2009

Related U.S. Application Data

(60) Provisional application No. 61/064,492, filed on Mar. 7, 2008.

(51) Int. Cl.

| | |
|---|---|
| ***B05C 17/06*** | (2006.01) |
| ***B41F 15/04*** | (2006.01) |
| ***B41F 15/22*** | (2006.01) |
| ***B41F 15/08*** | (2006.01) |

(52) U.S. Cl.

CPC ..... *B41F 15/0863* (2013.01); *B41F 15/22* (2013.01)

USPC ..... 101/126; 101/115

(58) Field of Classification Search

USPC ..... 101/115, 123, 126

See application file for complete search history.

(56) References Cited

U.S. PATENT DOCUMENTS

| | | | | |
|---|---|---|---|---|
| 2,206,176 | A * | 7/1940 | Foard | 101/126 |
| 2,610,577 | A * | 9/1952 | Heintges | 101/115 |
| 4,195,567 | A * | 4/1980 | Mitter | 101/115 |
| 4,407,195 | A * | 10/1983 | Jaffa | 101/123 |
| 4,911,070 | A | 3/1990 | Miske et al. | |
| 5,107,760 | A * | 4/1992 | Pratt | 101/115 |
| 5,279,220 | A * | 1/1994 | Clifton et al. | 101/126 |
| 5,588,770 | A * | 12/1996 | Bart | 403/325 |
| 5,775,221 | A * | 7/1998 | Bill | 101/128.1 |
| 5,953,987 | A * | 9/1999 | Oleson | 101/127.1 |
| 6,098,538 | A * | 8/2000 | Hamu | 101/126 |
| 6,152,031 | A * | 11/2000 | DeCruz | 101/129 |
| 6,240,841 | B1 * | 6/2001 | Newman et al. | 101/126 |
| 6,640,714 | B1 * | 11/2003 | Papa | 101/474 |
| 2005/0223919 | A1 * | 10/2005 | Oleson | 101/127.1 |
| 2007/0240589 | A1 * | 10/2007 | Eppinger | 101/126 |

OTHER PUBLICATIONS http://www.brownmfg.net/#6NumberPrinter/slider_number_system.htm, Dec. 2011.

http://www.brownmfg.net/#6NumberPrinter/numberprinter.htm, Dec. 2011.

* cited by examiner

*Primary Examiner* — Ren Yan

(74) *Attorney, Agent, or Firm* — Brian J. Colandreo; Jeffrey T. Placker; Holland & Knight, LLP

(57) ABSTRACT

A printing apparatus operatively connectable to a mounting arm that comprises an interchangeable pallet unit with a longitudinal axis and operatively connectable to the mounting arm for movement along the longitudinal axis, an indexing mechanism operatively connected to the interchangeable pallet so as to permit the interchangeable pallet indexed movement in a direction transverse to said longitudinal axis, and a bar unit operatively connectable to the mounting arm configured to receive a printing screen.

13 Claims, 48 Drawing Sheets

ANIMATION SEQUENCE 11

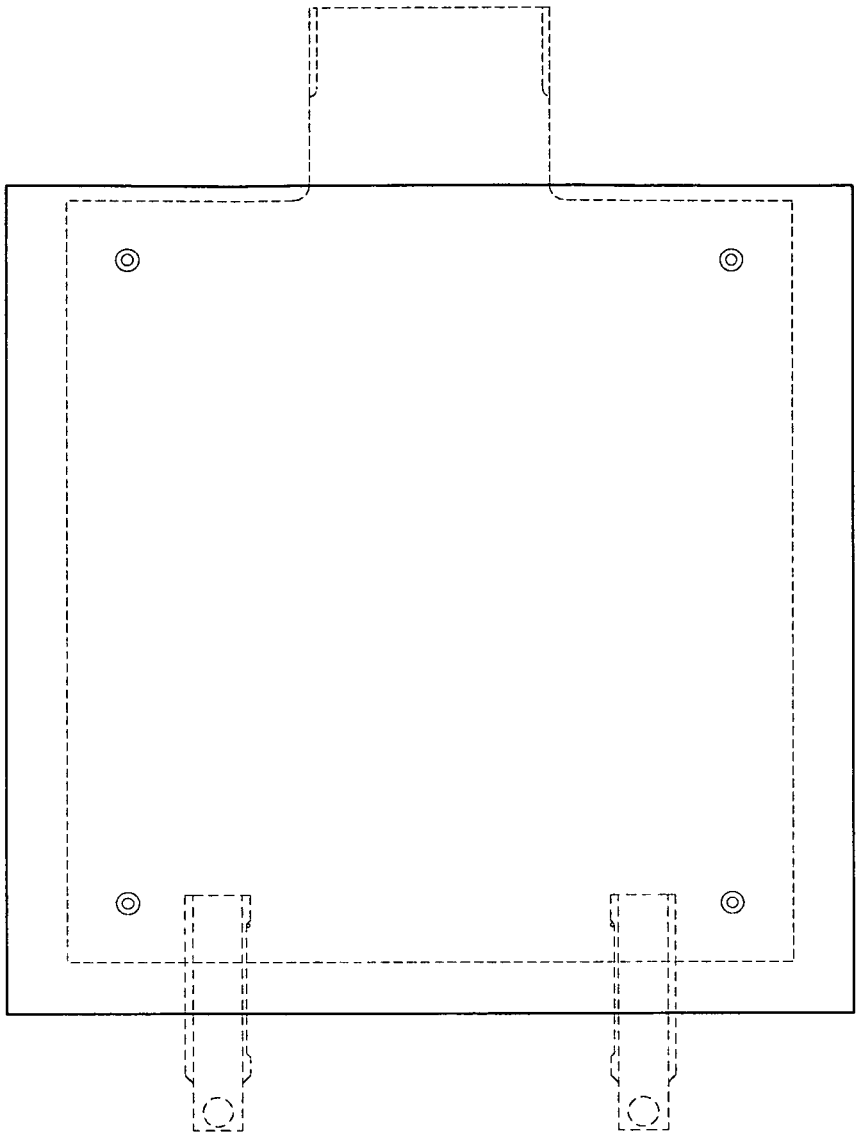
FIGURE 16A
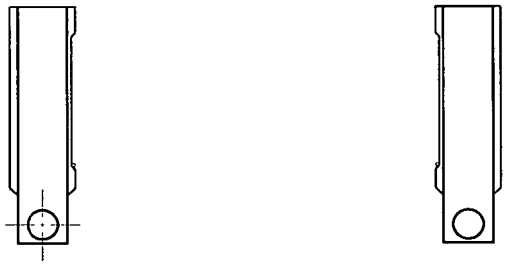
FIGURE 16B
FIGURE 16C

ANIMATION SEQUENCE 1

ANIMATION SEQUENCE 2

ANIMATION SEQUENCE 3

ANIMATION SEQUENCE 4

Animation Sequence 5

ANIMATION SEQUENCE 6

ANIMATION SEQUENCE 9

ANIMATION SEQUENCE 10

ANIMATION SEQUENCE 11

ANIMATION SEQUENCE 12

ANIMATION SEQUENCE 13

ANIMATION SEQUENCE 14

ANIMATION SEQUENCE 15

Animation Sequence 16

ANIMATION SEQUENCE 17

ANIMATION SEQUENCE 1B

ANIMATION SEQUENCE 19

ANIMATION SEQUENCE 20

ANIMATION SEQUENCE 21

Animation Sequence 22

Animation Sequence 23

ANIMATION SEQUENCE 24

ANIMATION SEQUENCE 25

ANIMATION SEQUENCE 26

ANIMATION SEQUENCE 27

ANIMATION SEQUENCE 28

PRINTING APPARATUS

This invention claims the benefit of U.S. Provisional Patent Application No. 61/064,492 filed on Mar. 7, 2008, which is hereby incorporated by reference in its entirety.

BACKGROUND OF THE INVENTION

The illustrative embodiments of the invention disclosed herein relate to a printing apparatus, and more particularly, to a screen printing apparatus for printing on, for example garments, fabrics, and accessories. Although embodiments of the invention are suitable for a wide scope of applications, it is particularly suitable for repeatedly printing on desired objects in a desired location.

SUMMARY OF THE INVENTION

Accordingly, embodiments of the invention are directed to a printing apparatus that substantially obviates one or more of the problems due to limitations and disadvantages of the related art.

An object of embodiments of the invention is to provide a simple printing apparatus.

Another object of embodiments of the invention is to provide of a simple screen printing apparatus.

A further object of embodiments of the invention is to provide a simple printing apparatus that allows precise, quick screen printing on a variety of different objects.

A further object of embodiments of the invention is to provide a compact printing apparatus.

Still a further object of embodiments of the invention is to improve screen printing, such as that used to print on garments.

Additional features and advantages of embodiments of the invention will be set forth in the description that follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, the printing apparatus includes A printing apparatus operatively connectable to a mounting arm, comprising: an interchangeable pallet unit having a longitudinal axis and being operatively connectable to the mounting arm for movement along said longitudinal axis; an indexing mechanism operatively connected to the interchangeable pallet so as to permit the interchangeable pallet indexed movement in a direction transverse to the longitudinal axis; and a bar unit operatively connectable to the mounting arm configured to receive a printing screen.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

FIGS. 16A-16C illustrate bottom, top and end views of an exemplary pallet for jackets;

FIG. 21; illustrates a user, ten print screens and a portion of a rotary print machine;

FIG. 22 illustrates an exploded view of an apparatus in accordance with an embodiment of the present invention, including an interchangeable pallet with an indexing mechanism, and a bar unit FIG. 23 illustrates the bar unit clamped into a typical rotary press print head;

FIG. 24 illustrates an interchangeable pallet unit positioned on a mounting arm of the rotary press machine;

FIG. 25 illustrates an embodiment of the present invention positioned for a user to use the apparatus;

FIG. 26 illustrates a user preparing to insert print screens into an apparatus embodying the present invention;

FIG. 27 illustrates a user preparing to insert a print screen into an apparatus embodying the present invention;

FIG. 28 illustrates a user tiling an apparatus embodying the present invention down;

FIG. 29 illustrates print screens positioned to be placed into a rack unit;

FIG. 30 illustrates print screens placed into a rack unit and a garment ready for printing;

FIG. 31 illustrates the bar unit tilted back away from the user;

FIG. 32 illustrates an interchangeable pallet unit and bar unit ready for a garment;

FIG. 33 illustrates an interchangeable pallet being tilted up to disengage from an index point, shown central of an indexing bar so as to allow side-to-side movement of the interchangeable pallet;

FIG. 34 illustrates an interchangeable pallet being moved to the left and the indexing bar being positioned with a different indexing notch aligned with the index point;

FIG. 35 illustrates an interchangeable pallet positioned with the index point positioned at the 8" slot/notch;

FIG. 36 illustrates an interchangeable pallet repositioned in a folded or tilted down position with the index point in the 8" inch slot/notch;

FIG. 37 illustrates an interchangeable pallet and bar unit in a position ready for printing;

FIG. 38 illustrates a garment positioned on an interchangeable pallet and an 8" numeral screen being readied for printing;

FIG. 39 illustrates a screen positioned on the garment and in positioning pins;

FIG. 40 illustrates a position of a screen a garment for application of ink;

FIG. 41 illustrates a garment after the application of ink in the position shown in FIG. 40;

FIG. 42 illustrates an interchangeable pallet unit with the garment of FIG. 41, in a tilted up position such as in FIGS. 33 and 34;

FIG. 43 illustrates an interchangeable pallet unit with the garment of FIG. 41 moved to that the index point is now on the left hand side of the locator bar;

FIG. 44 illustrates an interchangeable pallet unit with the garment of FIG. 41 in a lowered position with the index point in the left had notch/index stop for printing the left portion of the desired graphic;

FIG. 45 illustrates a garment positioned on an interchangeable pallet and an 8" numeral screen being readied for printing;

FIG. 46 illustrates a screen positioned on the garment and in positioning pins;

FIG. 47 illustrates a garment after the application of ink in the position shown in FIG. 46; and FIG. 48 illustrated the completed printed garment.

DETAILED DESCRIPTION OF THE PREFERRED EMBODIMENTS

Figure 1:
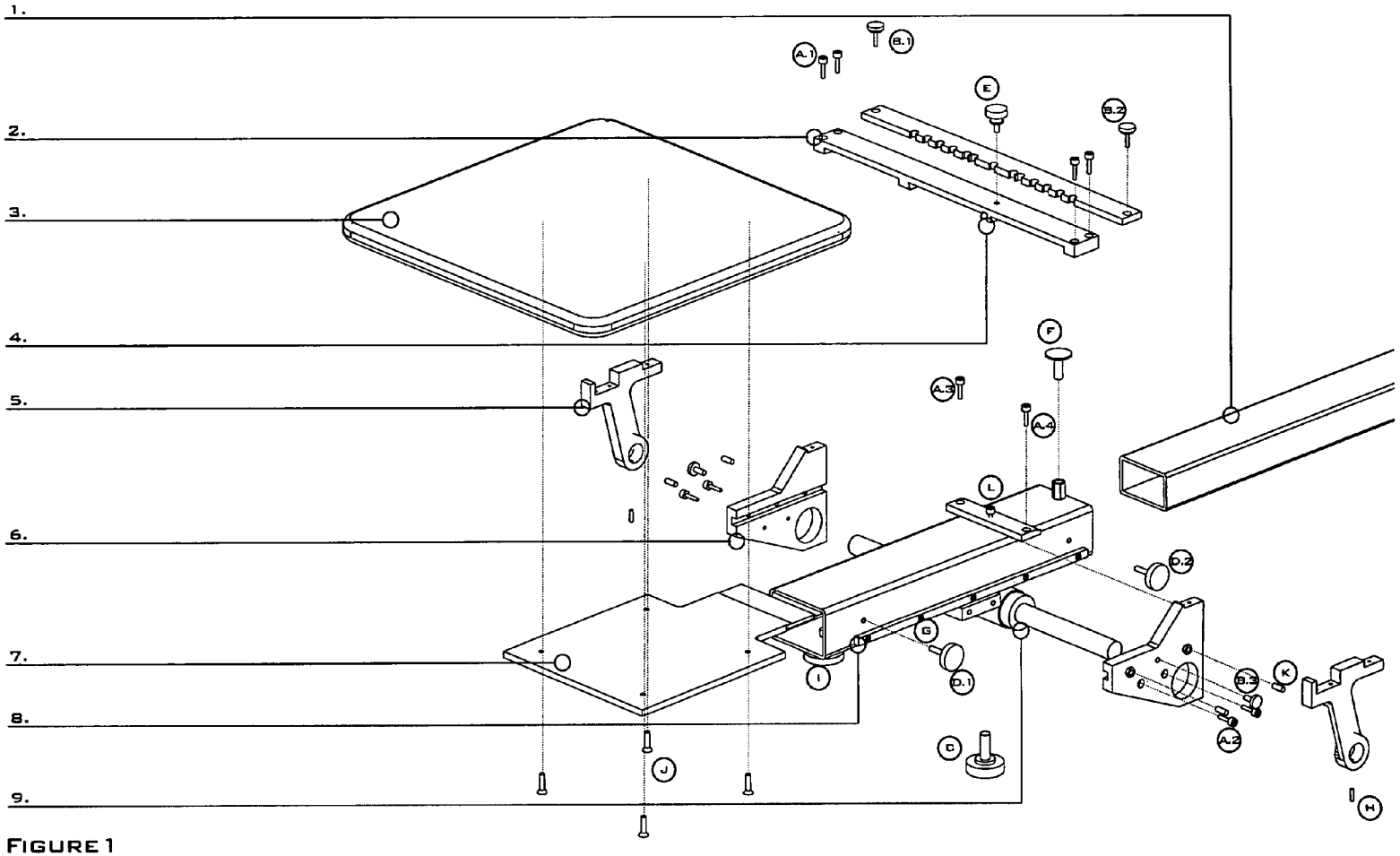
FIG. 1 illustrates one embodiment of a base unit in accordance with aspects of the present invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

In the illustrative embodiments of the printing apparatus of the present invention the apparatus includes three units, a base unit, a bar unit, and a rack unit. These units may be an integral structure, or they may be connectable to cooperate and operate together in accordance with aspects of the present invention.

Figure 2:
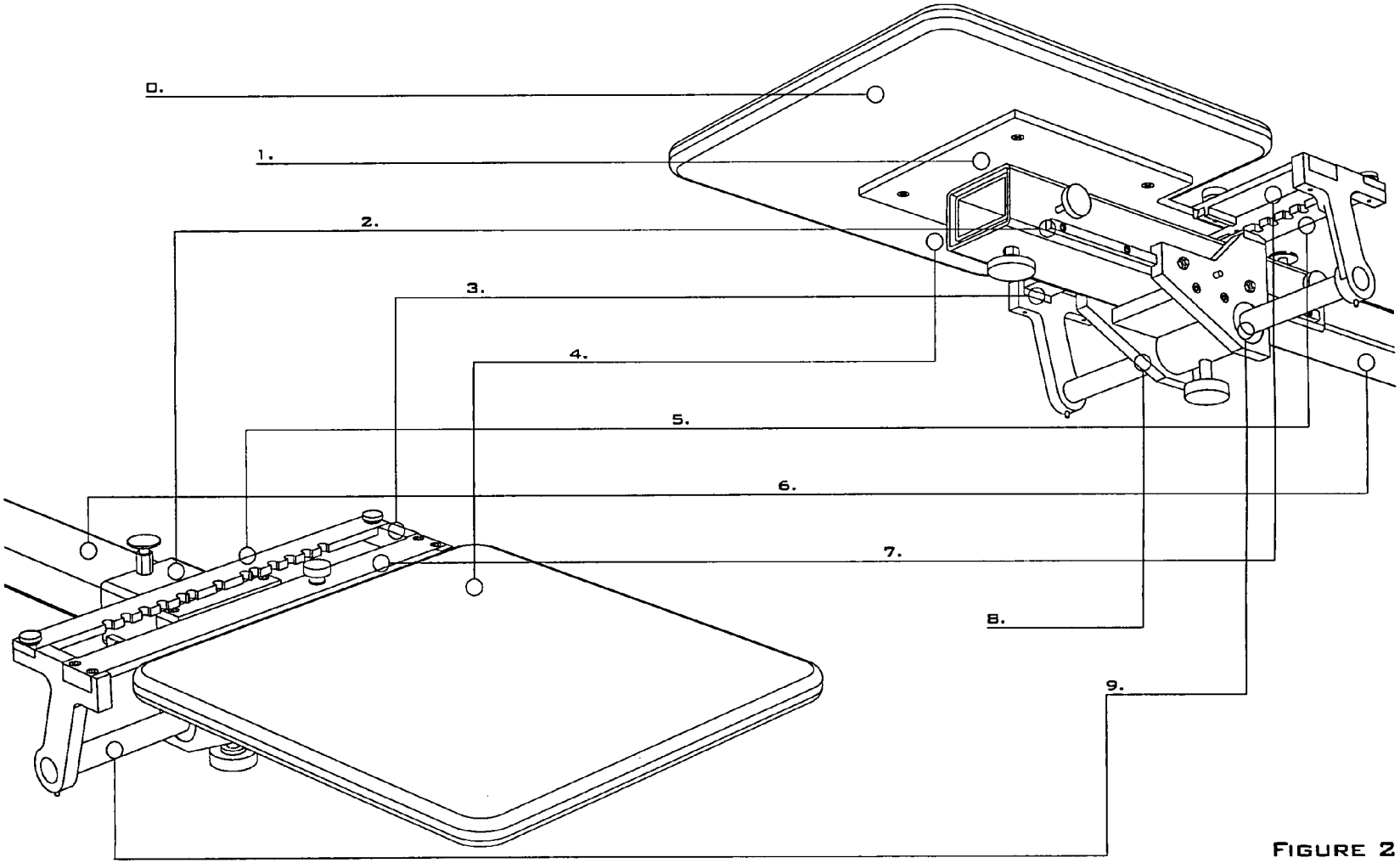
FIG. 2 illustrates an alternative view of the FIG. 1 embodiment.
Figure 6A:
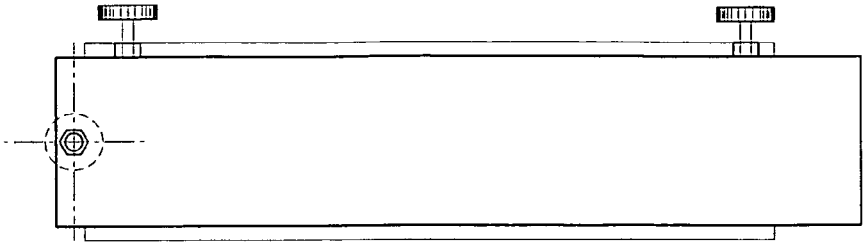
FIGS. 6A-6F illustrate an embodiment of portion of the FIG. 1 unit.
Figure 6B:
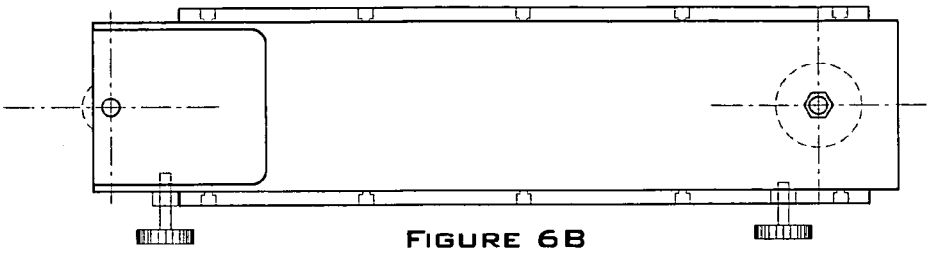
Figure 6C:
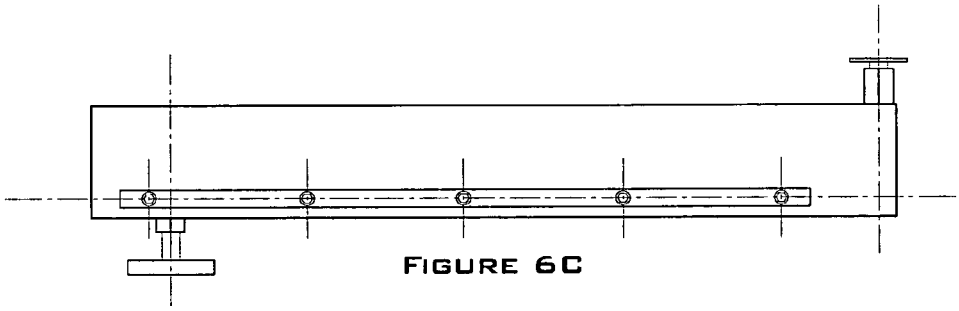
Figure 6D:
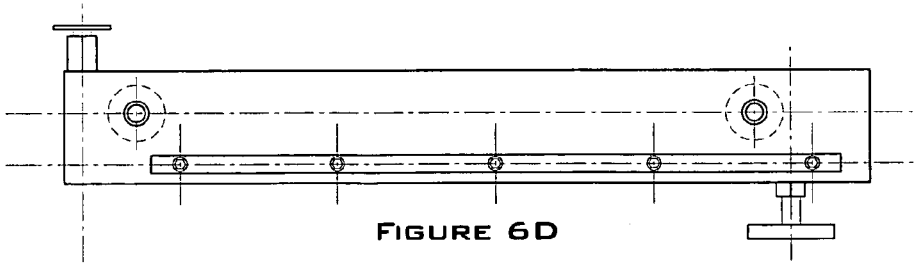
Figure 6E:
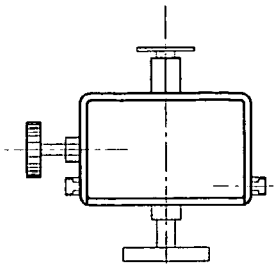
Figure 6F:
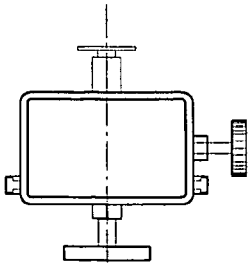
Figure 7A:
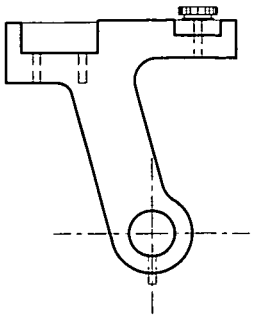
FIGS. 7A-7D, 8A-8D, 9A-9C and 10A-10D illustrate an embodiment of a slide guide and pivoting unit in accordance with an aspect of the present invention.
Figure 7B:
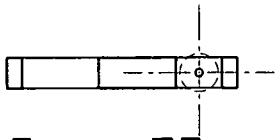
Figure 7C:
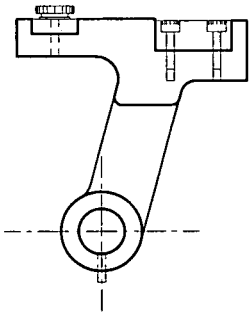
Figure 7D:
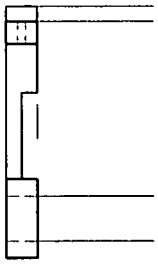
Figure 8A:
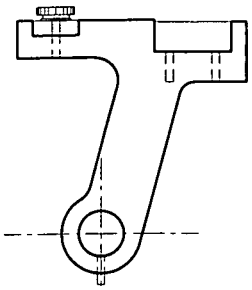
Figure 8B:
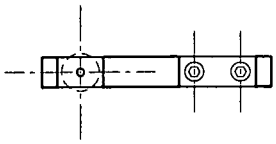
Figure 8C:
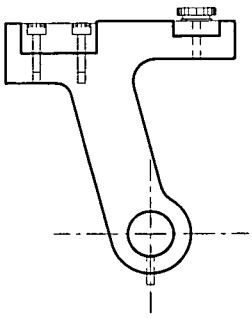
Figure 8D:
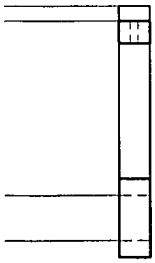
Figure 9A:
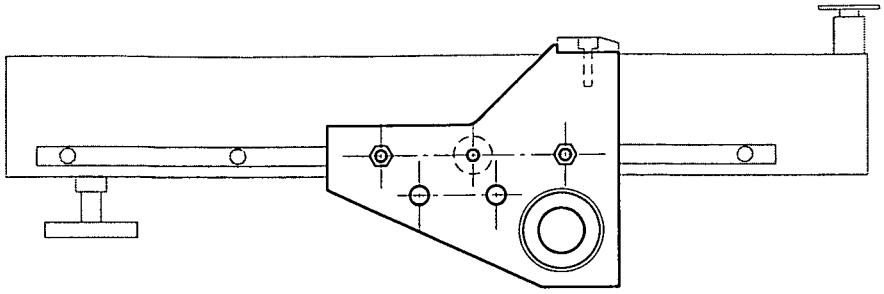
Figure 9B:
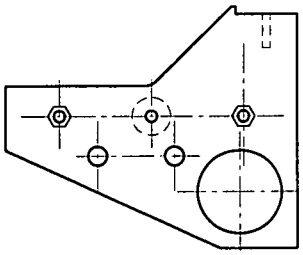
Figure 9C:
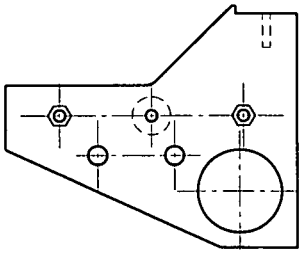
Figure 10A:
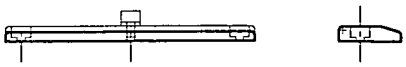
Figure 10B:
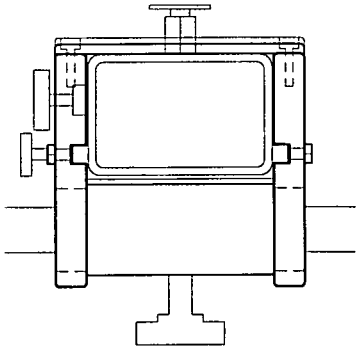
Figure 10C:
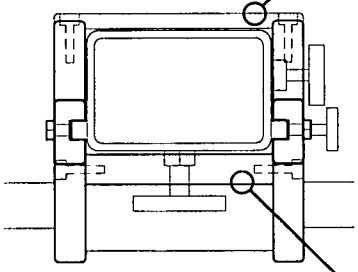
Figure 10D:
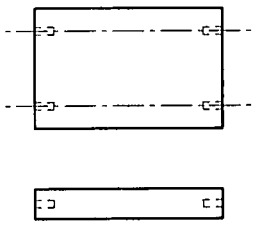
Figure 11A:
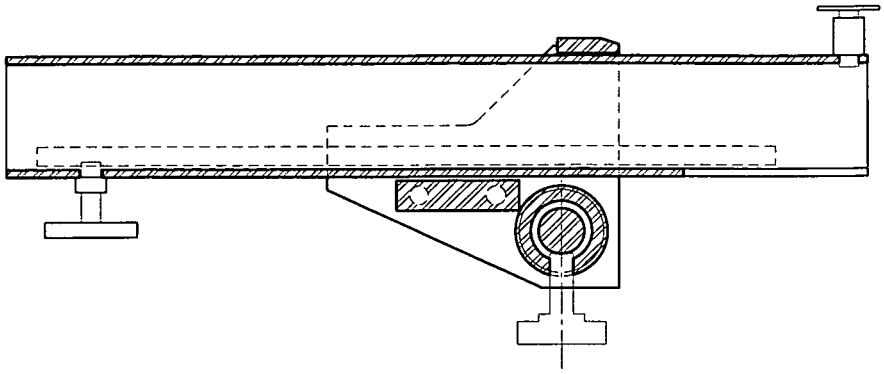
FIGS. 11A-11C illustrate sectional vies of FIG. 5D.
Figure 11B:
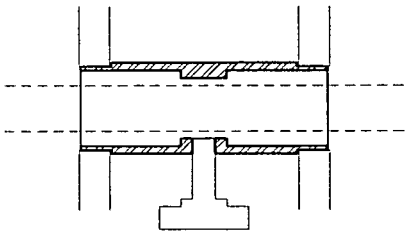
Figure 11C:
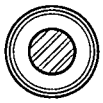
Figure 12A:
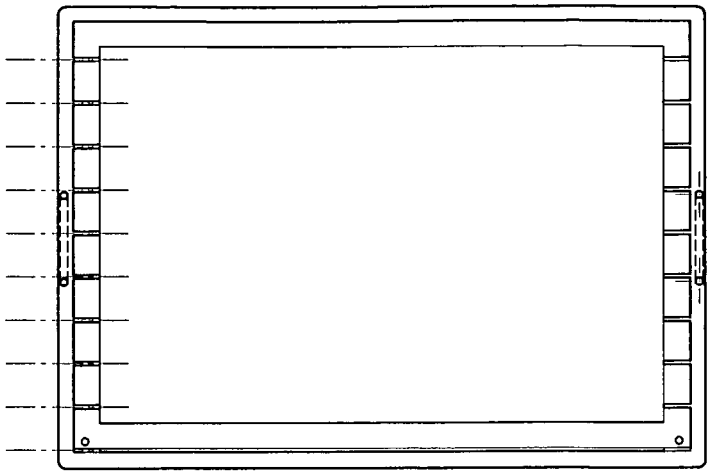
FIGS. 12A-12D illustrate a front exploded vies of an embodiment in accordance with the present invention.
Figure 12B:
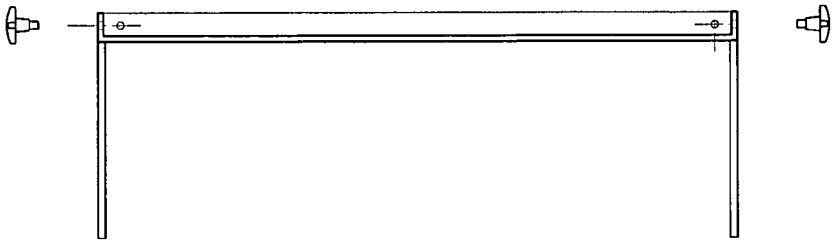
Figure 12C:
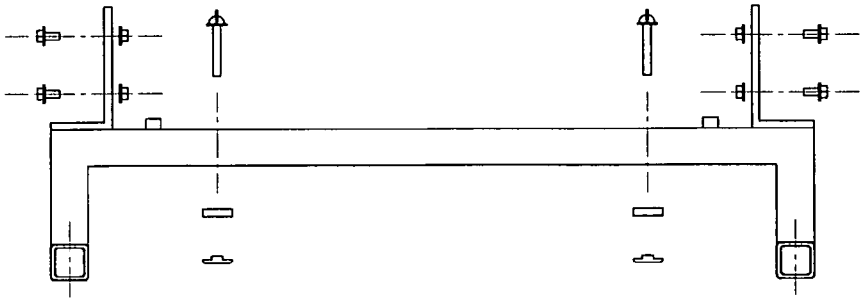
Figure 12D:
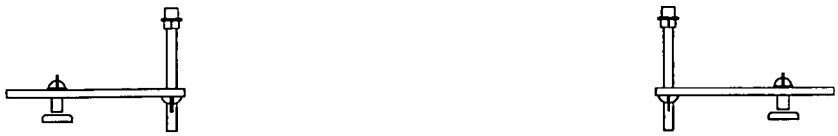

FIGS. 1 and 2 illustrate an embodiment of one aspect of the present invention. In these Figures, the illustrated exemplary base unit structure allows a pallet 3 to slide onto a typical textile rotary screen printing press arm 1. Illustrative examples of such textile rotary screen printing press include but are not limited to the 'Hopkins/BWM ProLine, Convertible, and Starting Line Series. The base unit can be slid, attached, or integrally constructed to as desired. For example, the base unit can include a mounting sleeve unit (see, e.g., FIG. 1 reference number 8, FIG. 2 reference number 2 and FIGS. 6A-6F) over any rotary textile press arm 1. An example rotary textile press arm is shown in FIG. 2 reference number 6. Once in a desired position, the base unit can be locked in place on the rotary textile press arm. Such locking can be accomplished via any suitable manner. For example, front and back lock down knobs as exemplified in FIG. 1 reference C, and FIGS. 6A-6C, reference S#4).

The illustrative structure shown in FIG. 2 includes an embodiment of a base unit. The FIG. 2 structure also allows an interchangeable pallet (FIG. 1 reference number 3) to slide from side to side. This side-to-side movement can be accomplished via a variety of mechanisms. For example, the use of a ball bearing tube and a ball bearing shaft (see, e.g., FIG. 2 reference number 9 and FIGS. 7, 8, 9, 10 and 11) can be used to provide side-to-side movement, although any suitable mechanical arrangement can be employed. The side-to-side movement in the illustrative embodiment occurs when the interchangeable pallet unit 3 is released from interchangeable locator bar slots or notches (see, e.g., FIG. 2 reference number 5 for locator bar) and a side force is applied to the interchangeable pallet unit 3. This movement is also illustrated in an exemplary animation sequence of FIG. 14, which depicts an example of the above-noted release, and in FIG. 15 that illustrates side-to-side movement. Once in position, side-to-side movement can prevented by using a lock down knob for the gliding ball bearing shaft (see, e.g., FIGS. 1-3 and FIGS. 11A-11B, reference S#3).

FIG. 2 also illustrates an example structure of a pivoting head, and gliding unit (e.g., reference numbers 3 and 8 and FIGS. 7, 8, 9, 10). The gliding unit allows also allows forward and backward movement along the mounting bar (FIG. 2 reference number 6). In the illustrative embodiment, forward and rearward sliding can occur by moving the unit along glide bars attached to the mounting sleeve unit (see, e.g., FIG. 2 reference number 2 for both). This movement can be prevented or locked by using lock down knobs for the pivoting head, and gliding unit (see, e.g., FIG. 1—reference B.3 and FIGS. 9B-9C, reference S#2).

The embodiments shown in FIGS. 1 and 2 also illustrate an example of an indexing mechanism (see, e.g., FIG. 1 reference number 2 and FIG. 2 reference number 5). In this example, the indexing mechanism allows the interchangeable pallet unit (see, e.g., FIG. 2 reference number 0) to be locked into a desired position for screen printing (see, e.g., Animation sequences reference numbers 16 and 17).

Figure 4A:
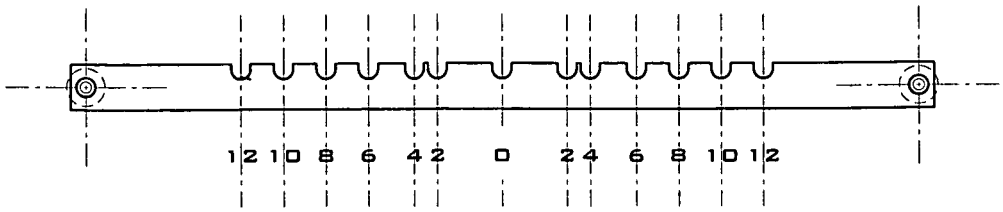
FIGS. 4A-4E illustrate an embodiment of a portion of an indexing mechanism in accordance with aspects of the present invention.
Figure 4B:
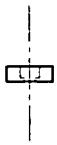
Figure 4C:
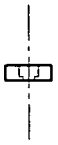
Figure 4D:
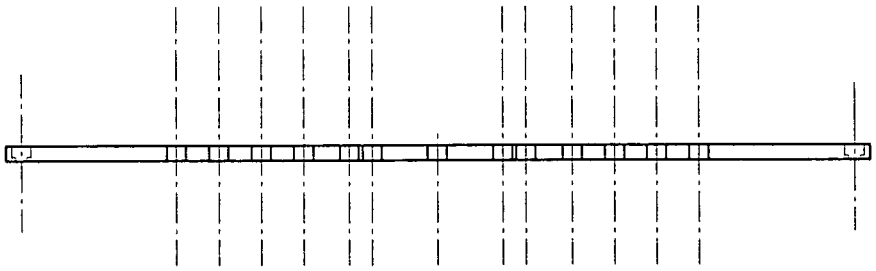
Figure 4E:
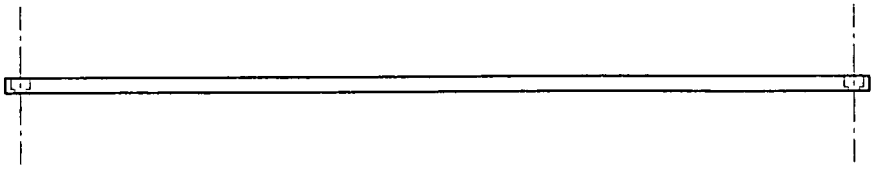
Figure 5A:
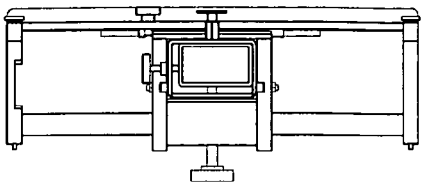
FIGS. 5A-5D illustrate an embodiment of an interchangeable pallet unit.
Figure 5B:
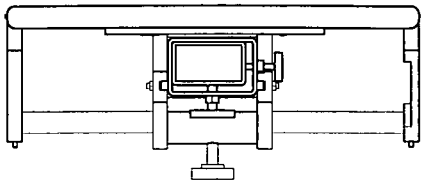
Figure 5C:
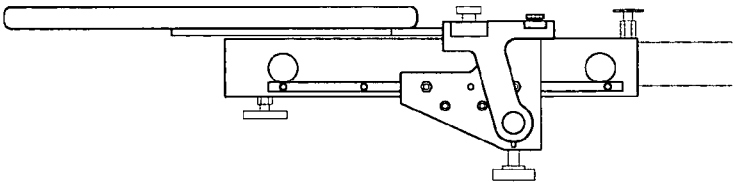
Figure 5D:
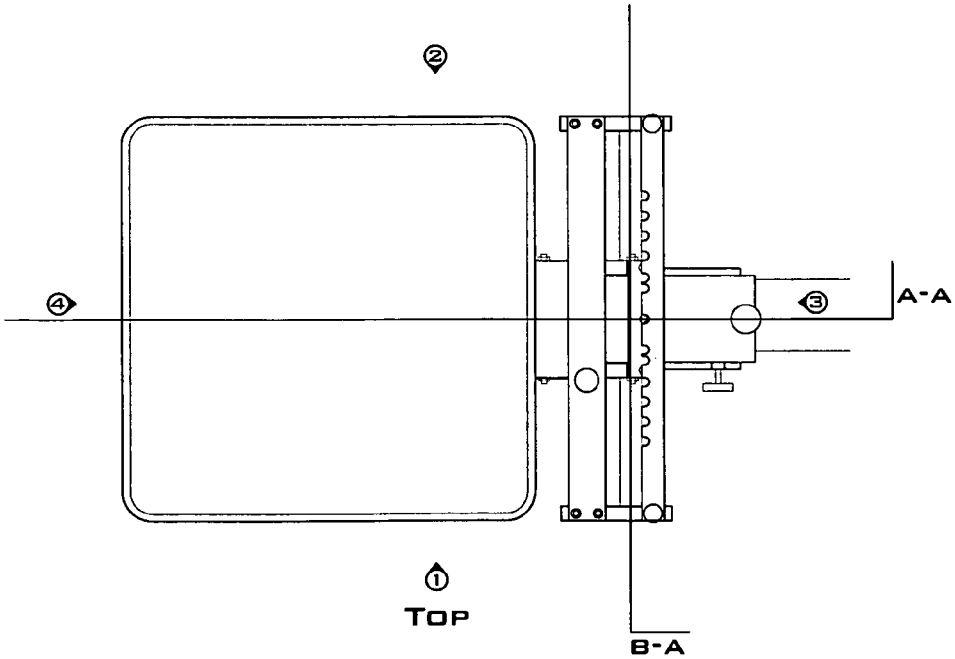
Figure 35:
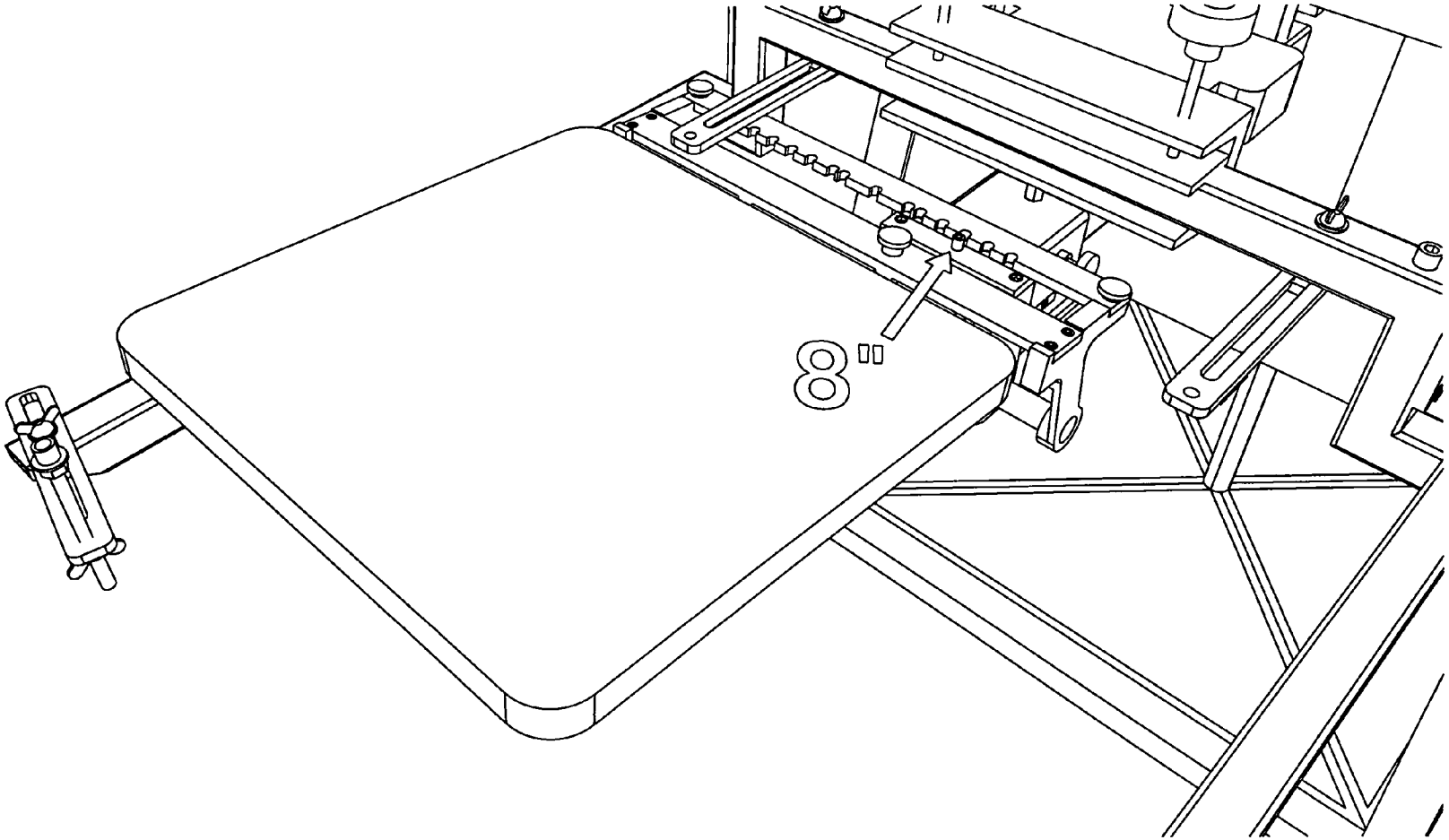

Referring to FIG. 1, the interchangeable pallet unit (see, e.g., FIG. 2 reference number 0) can be locked in any desired indexing position, such as the notches or index stops shown in FIG. 4A. To do so, the interchangeable pallet 3 is moved in a side-to-side motion (as illustrated by the arrow seen in FIG. 35). In the illustrative embodiment shown in the figures, this side-to-side movement can occur after pivoting or tilting the unit up and away from a user. This releases it from the interchangeable locator bar slots or notches as shown in FIG. 1 reference number 2; and allows the notches in FIG. 4A to be moved with respect to the index pin, such as the pin shown in FIG. 1, reference L, and identified by the 8" arrow in FIG. 35. In the illustrative example of an interchangeable locator bar (shown in FIG. 1 reference number 2), the slots or notches (see, e.g., FIG. 4A) can be placed as shown in the example of FIG. 4A. It will be recognized by those skilled in the art that the indexing mechanism can employ any suitable indexing scheme including but not limited to detents, a threaded screw assembly that allows side-to-side movement as, for example, the screw is rotated.

Figure 36:
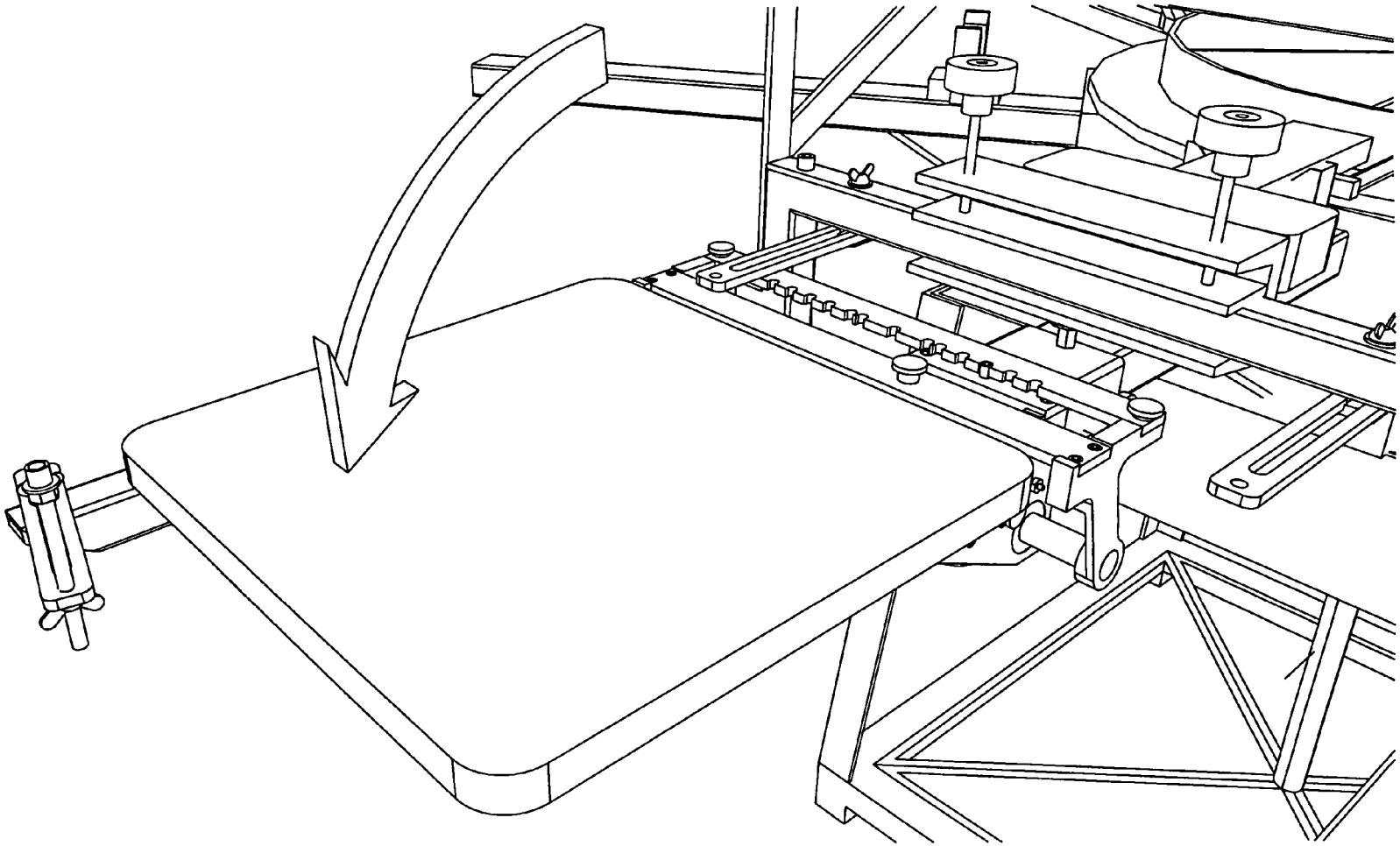
Figure 37:
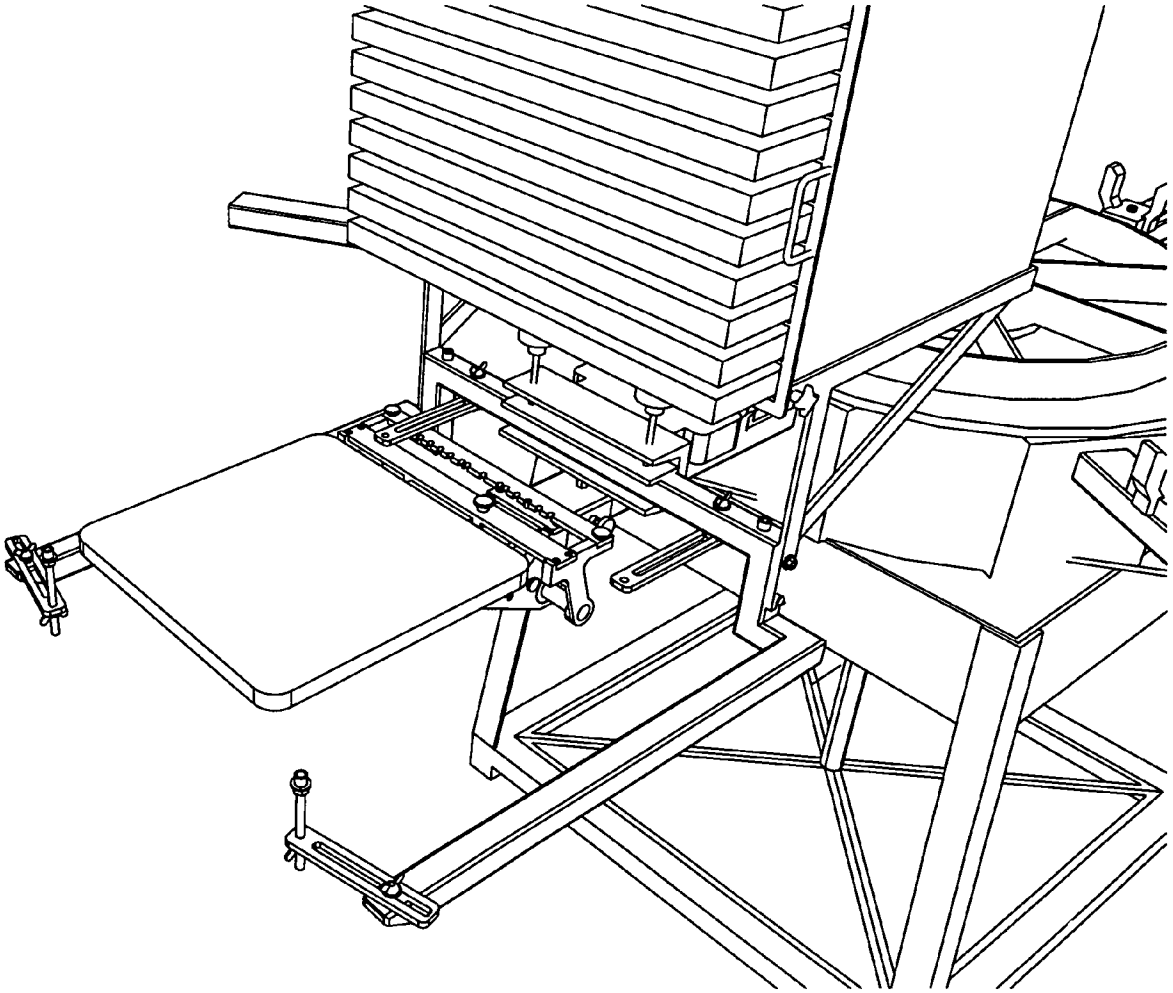

In the FIG. 4A example, one of the slots or notches can be used a center point upon which to lock the interchangeable pallet unit (FIG. 2 reference number 0) in a preparation position for screen printing (see, e.g., FIGS. 36 and 37). In the FIG. 4A example, the interchangeable locator bar includes six slots or notches cut to the left of center indicated by the numbers 2, 4, 6, 8, 10, and 12. It also includes six slots or notches cut on the right side of center indicated by the numbers 2, 4, 6, 8, 10, and 12, and a center slot indicated by the number 0. The slots or notches (seen in FIG. 4A) can be marked in such a manner as to allow an operator to determine what size text is required for a particular screen printing task. Normal sized numbers that are used for screen printing purposes are 2, 4, 6, 8, 10, and 12 inch (as indicated by the numbers used in the example on FIG. 4A). However, this system is not limited to any size numbers or number of slots or notches upon each locator bar.

Figure 38:
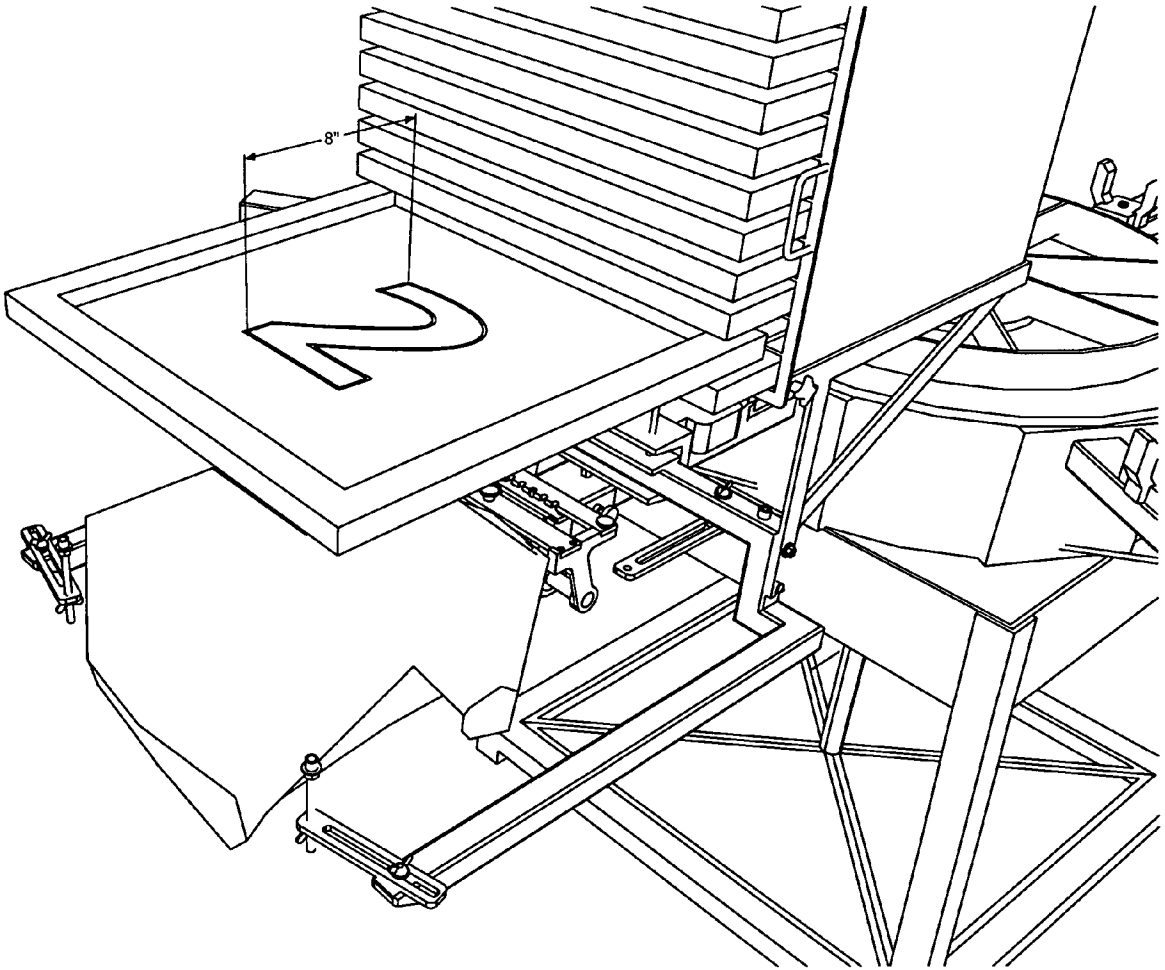
Figure 40:
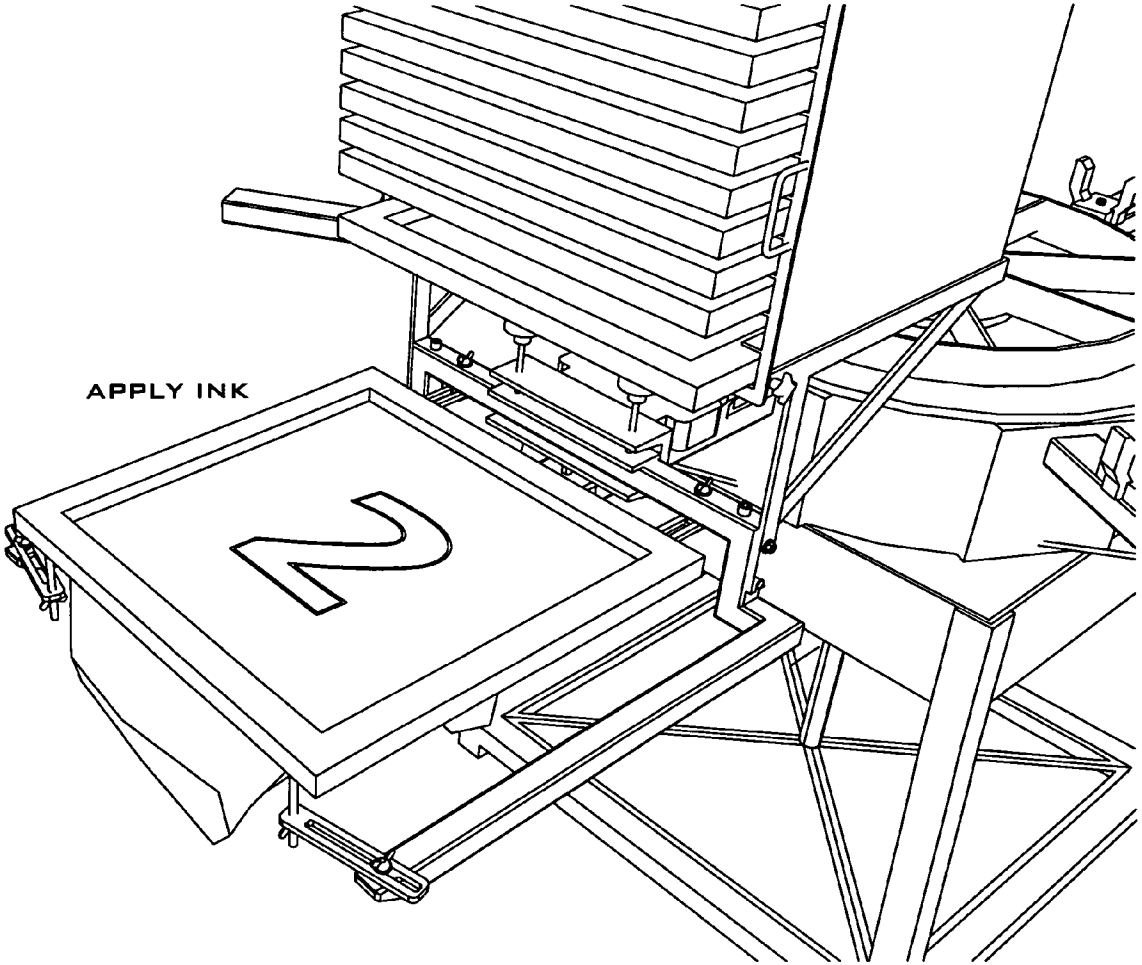
Figure 41:
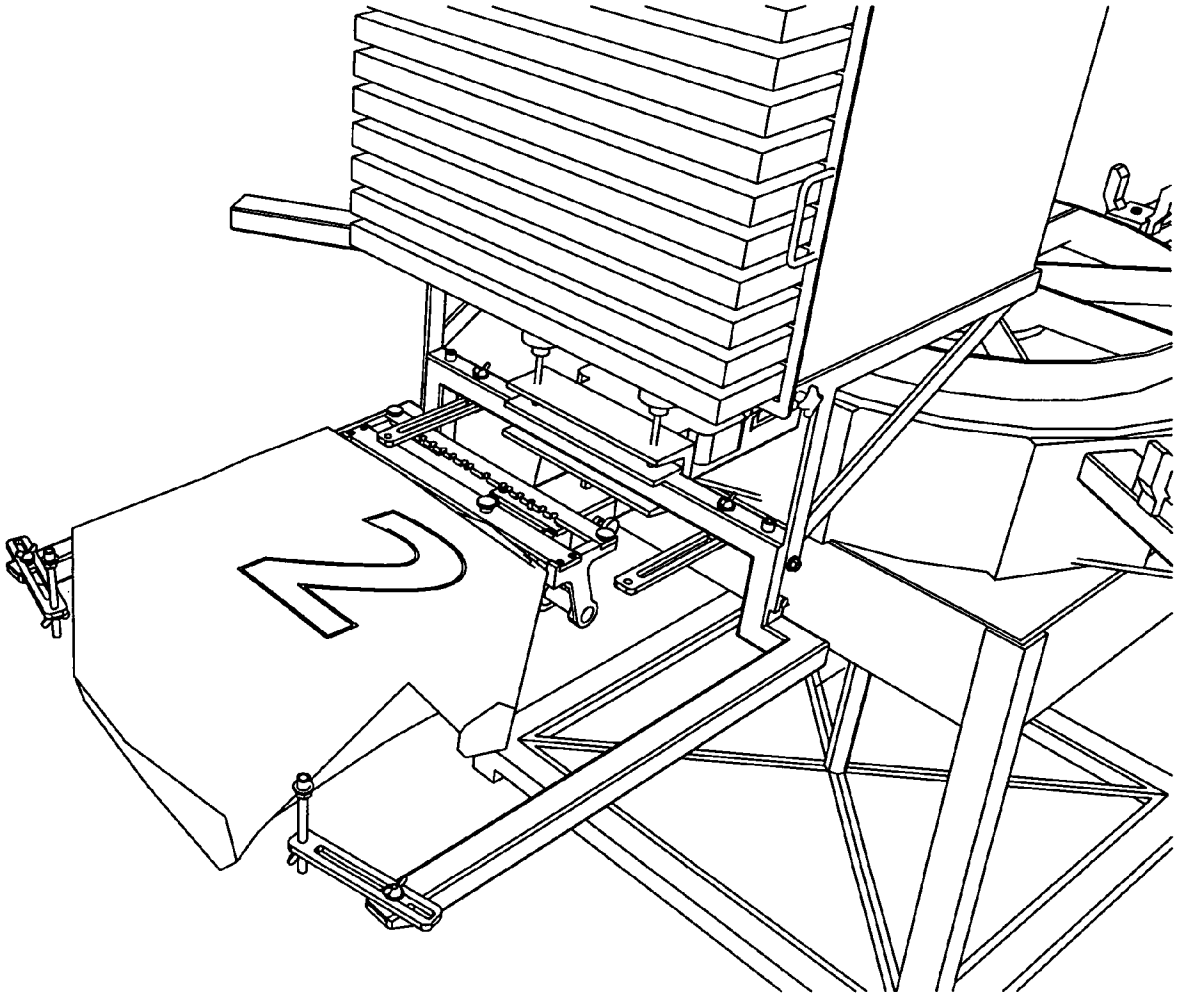
Figure 42:
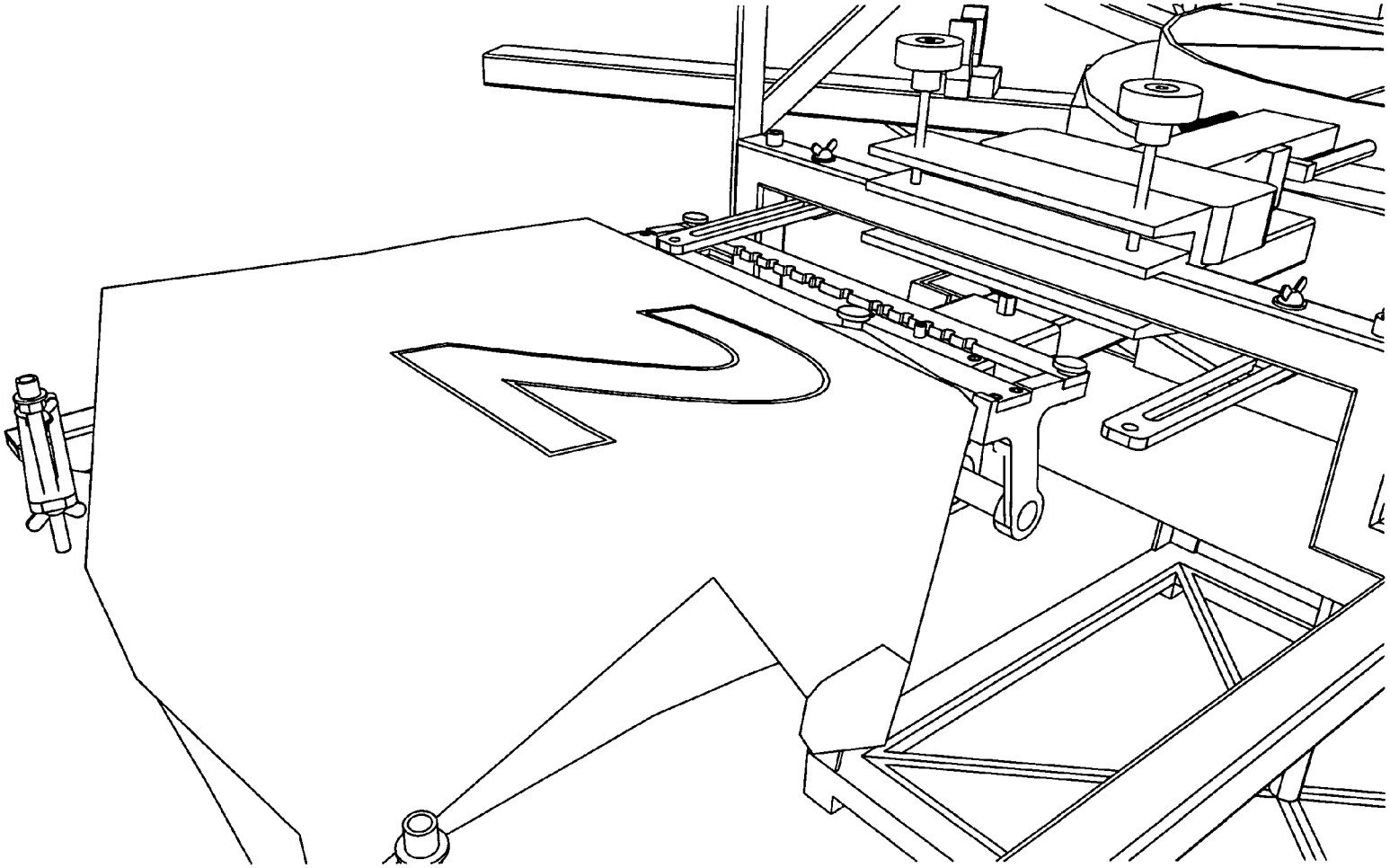
Figure 43:
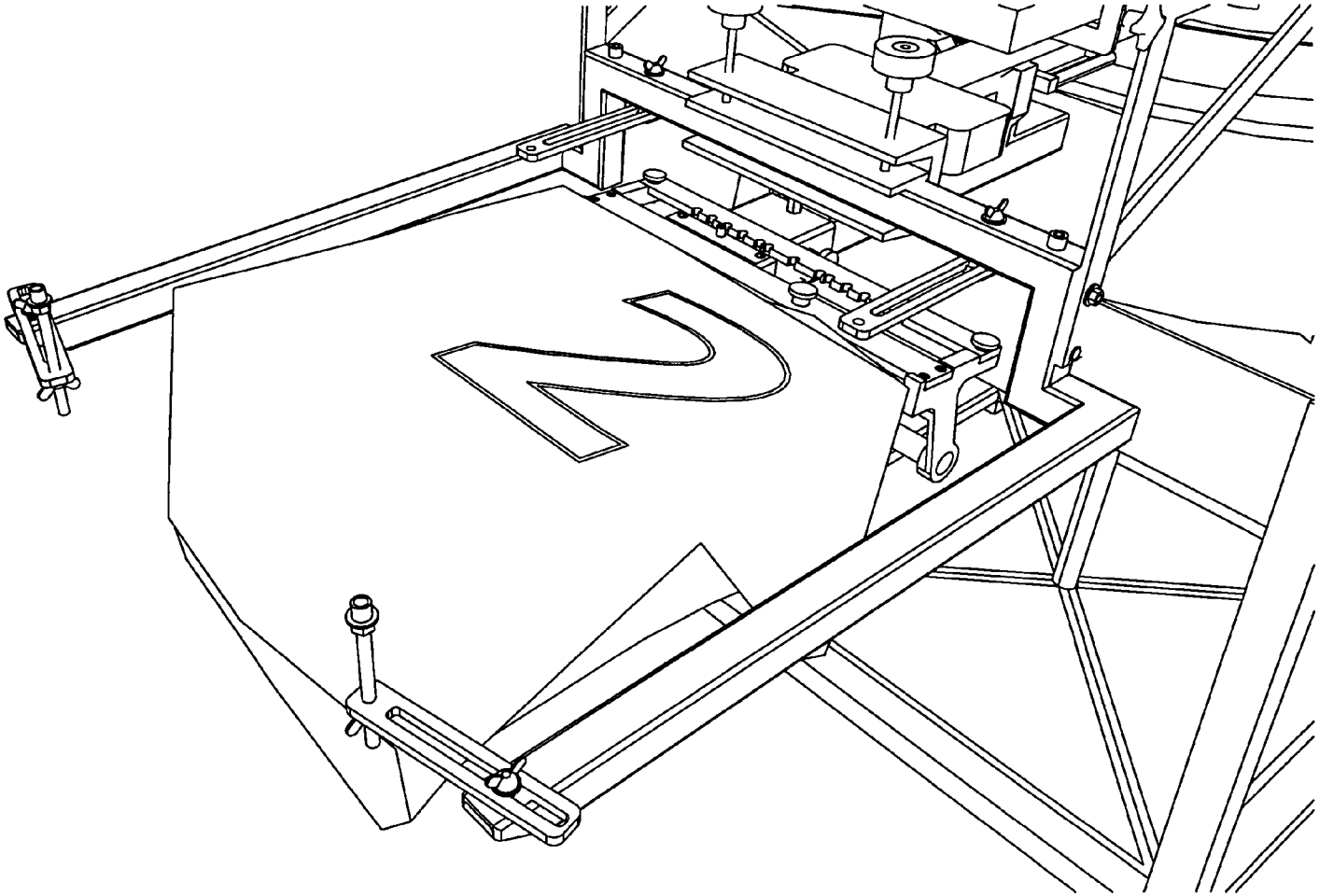
Figure 44:
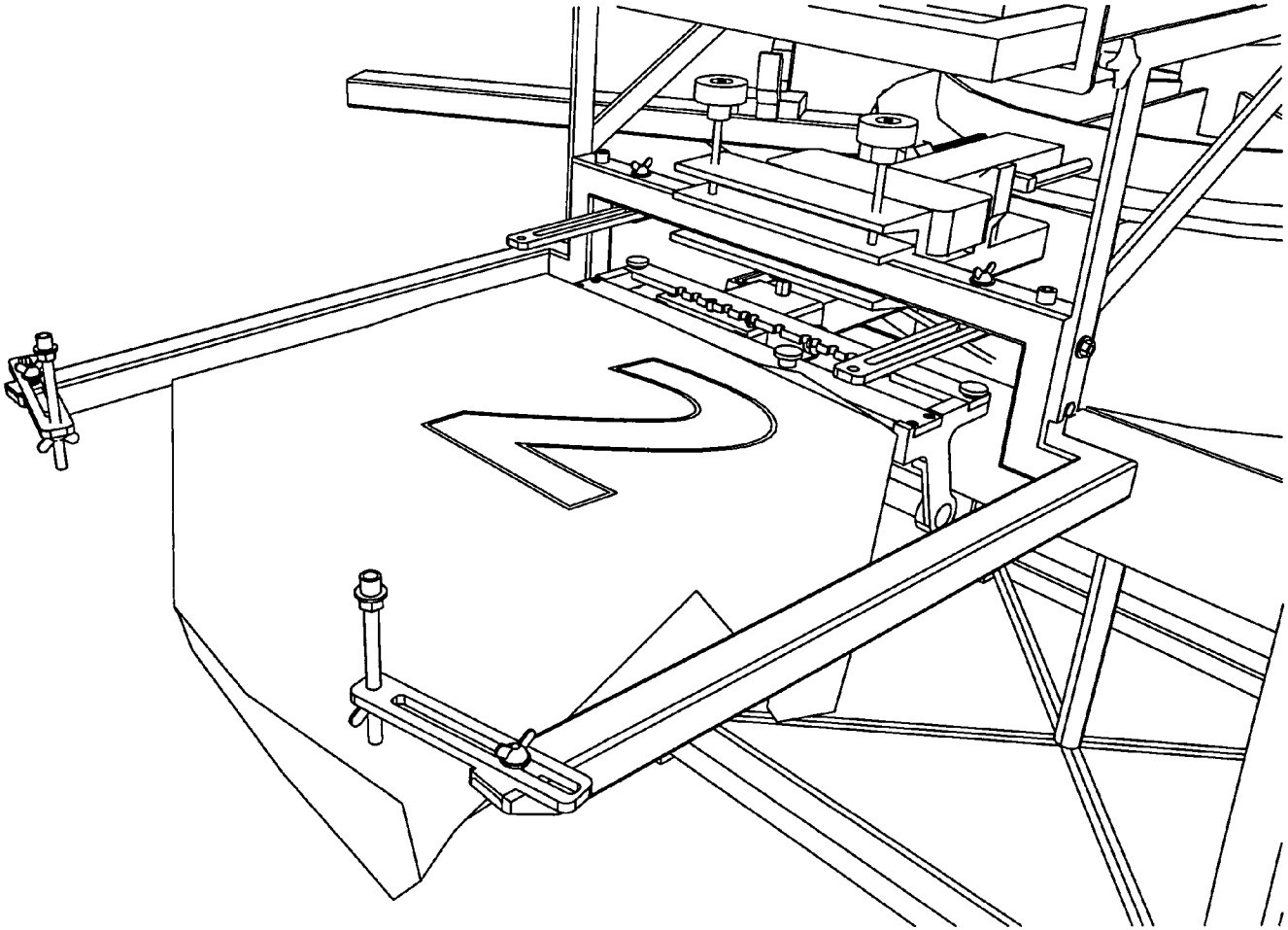
Figure 45:
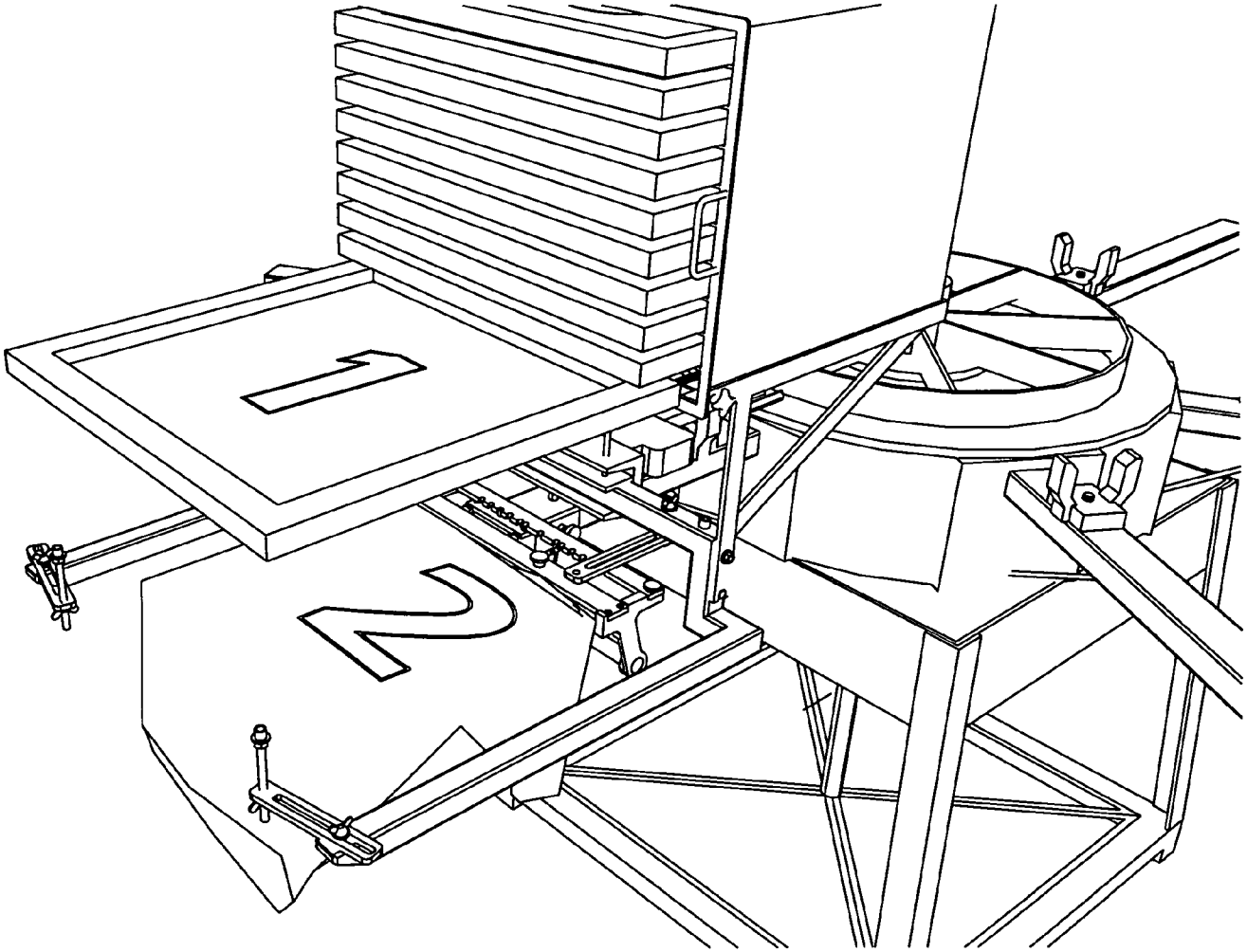
Figure 46:
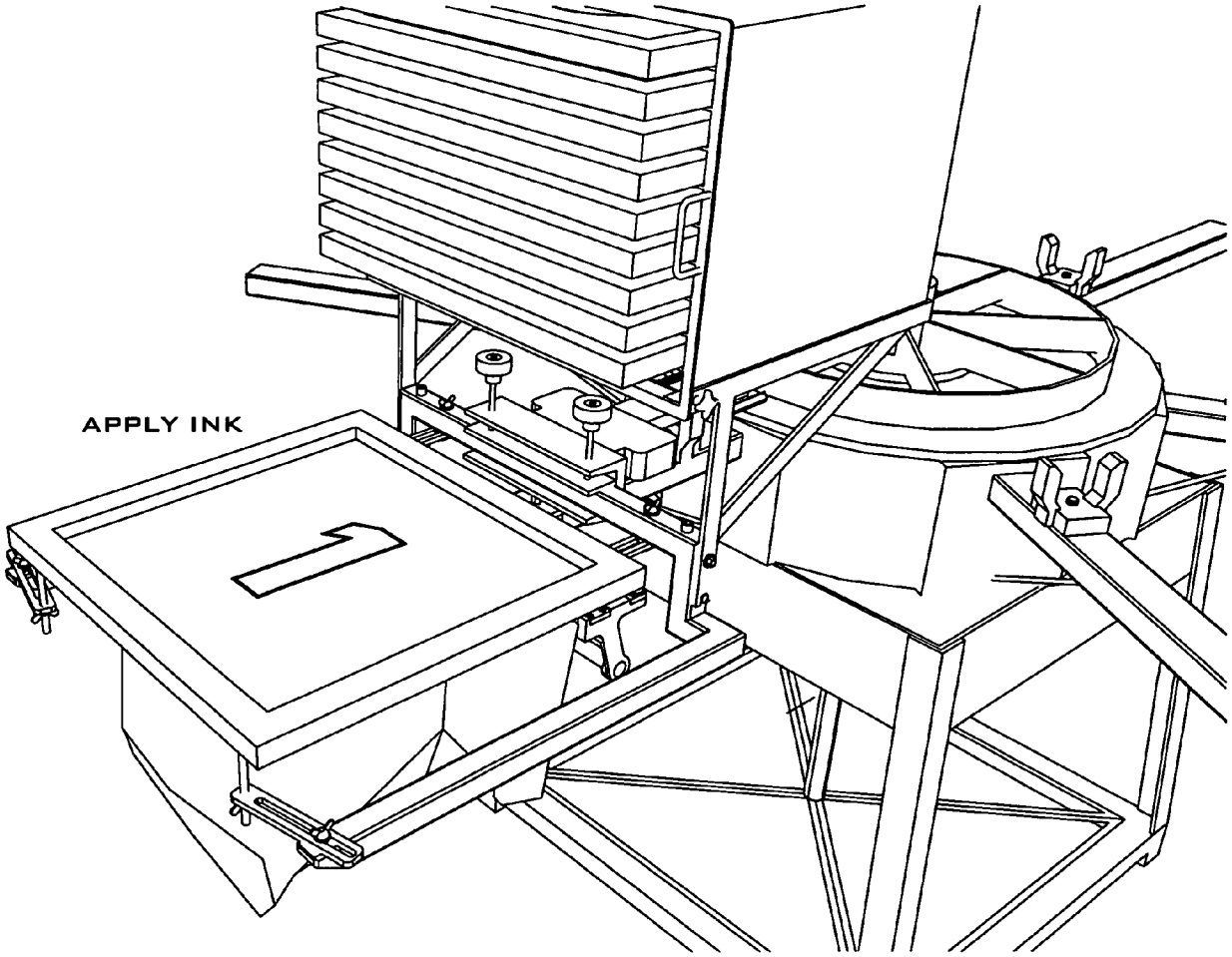
Figure 47:
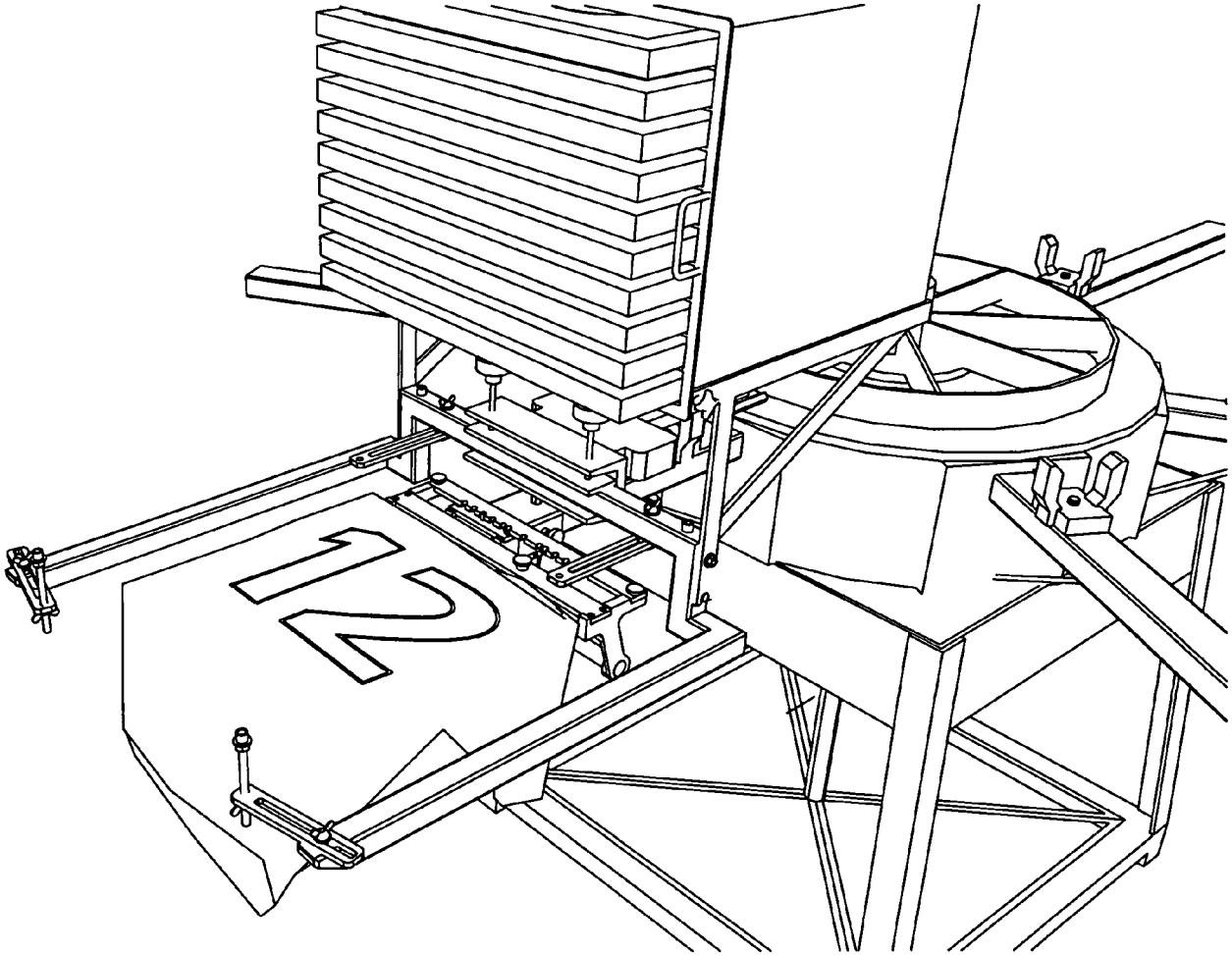
Figure 48:
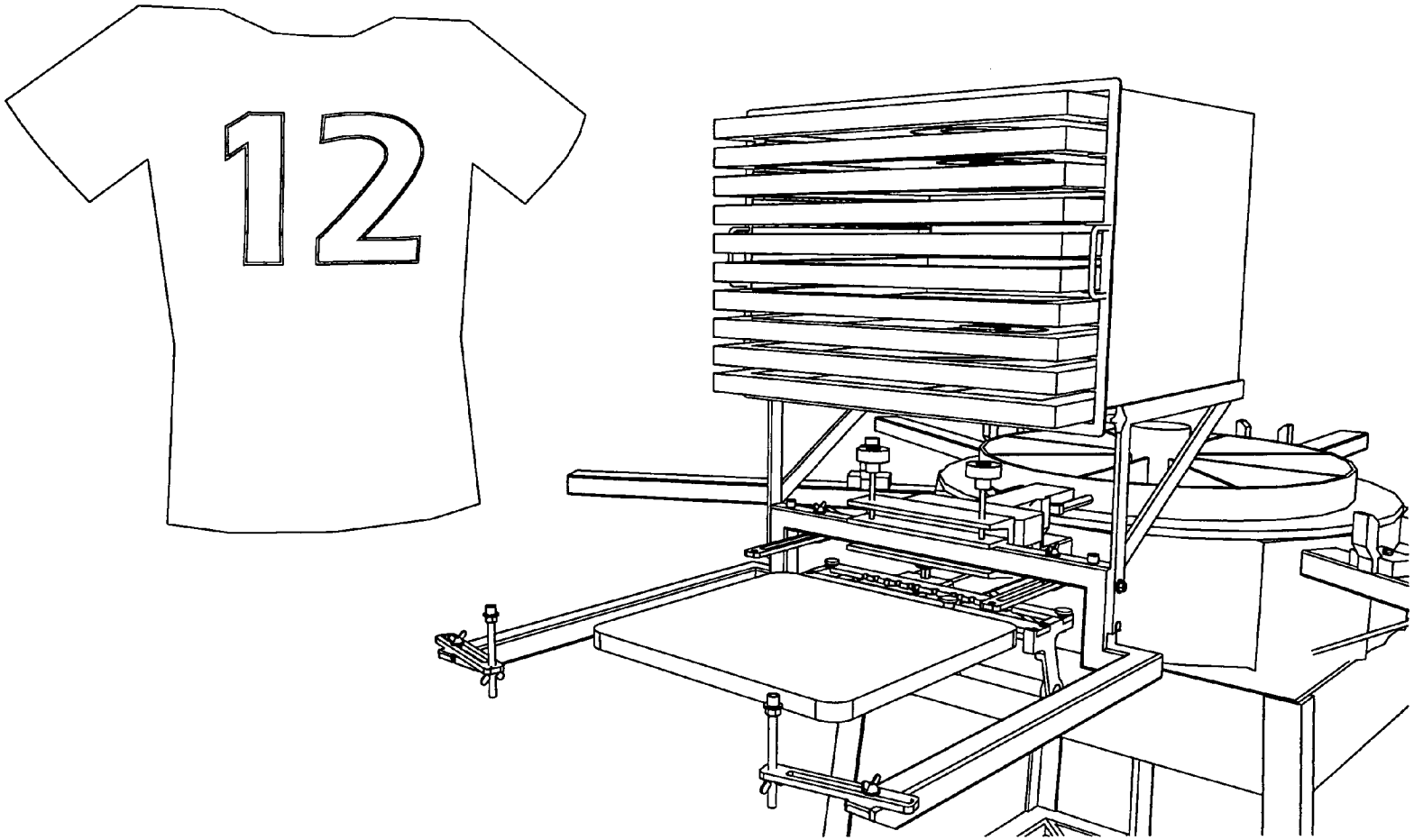

The illustrative embodiment shown in FIG. 1 also includes a locator pin (see, e.g., FIG. 1—reference L). The locator pin fits into the appropriate slot or notch (see, e.g., FIG. 4A) on the interchangeable locator bar (see, e.g., FIG. 1 reference number 2) in order to accommodate the size graphic that a certain screen printing task requires (see, e.g., FIG. 36 for an example requiring an 8" number screen printing task). The exemplary structure allows the interchangeable pallet unit (see, e.g., FIG. 2 reference number 0) to fit be placed in a precise position, and in turn positioning a garment which has been situated upon the interchangeable pallet unit in an appropriate location (see, e.g., FIG. 38). The object can then be screen printed with an applicably sized graphic upon it (in the Animation sequence example, the graphic was an 8" number). In the illustrated embodiment, the interchangeable locator bar (see, e.g., FIG. 1 reference number 2) is in a central area of the pivoting and head gliding unit. While this position is not required, it allows easy and precise alignment of garments during the screen printing process (see, e.g., FIG. 40 for an example of an 8" number being placed on the right side of a typical t-shirt garment).

The printing apparatus of the present invention allows printing quick, easy and precise s printing of any desired design, numbers, letters, pictures, logos, and other desired graphic design in any application, garment, hat, or material. For example, apparatus embodying the present invention allow a screen printer to easily set up and swap out an interchangeable pallet unit (see, e.g., FIG. 2 reference number 0), and perform simple adjustments with ease and efficiency. Apparatus embodying the present invention can print on any type of garment no matter the size or location upon which a graphic is intended to be printed. Examples of such troublesome issues that the present invention solves, include printing on double ply mesh shorts, hats, and nylon jackets, as well as attempting to place a logo or number on the top of the cowl of a garment or bag.

Figure 14A:
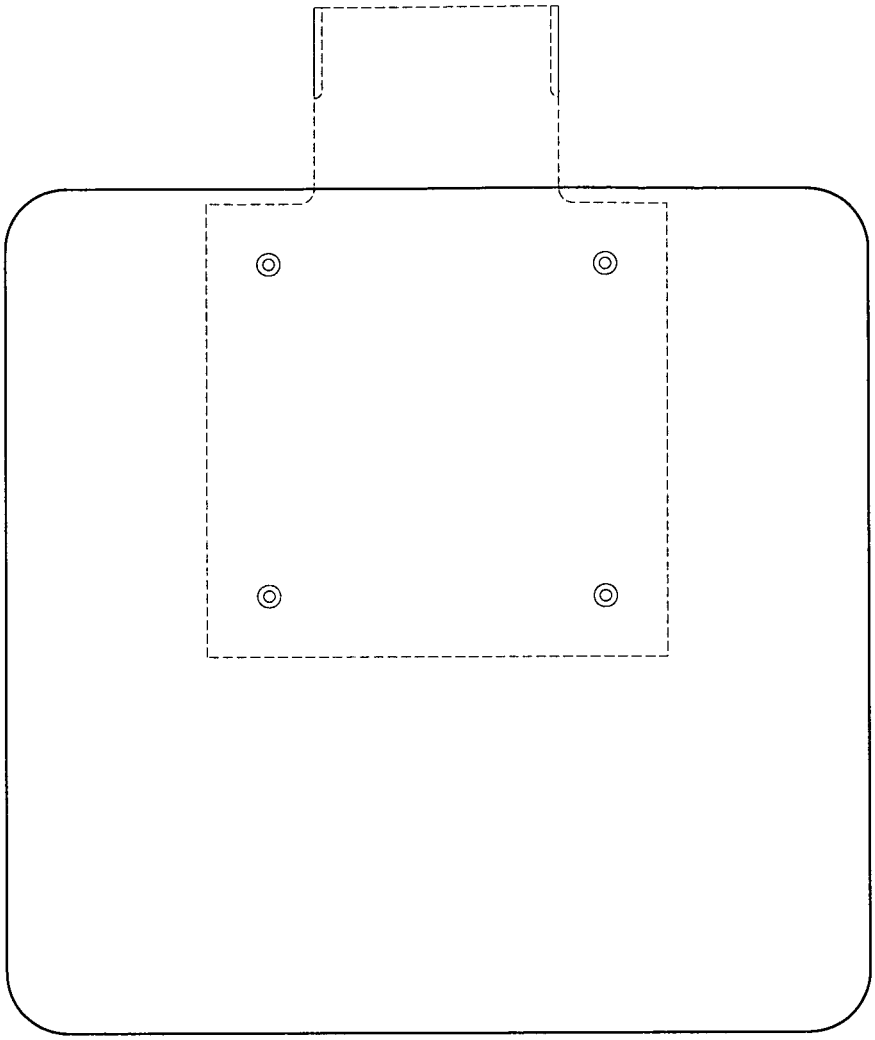
FIGS. 14A-14B illustrate bottom and front view of an exemplary pallet for shirts.
Figure 14B:
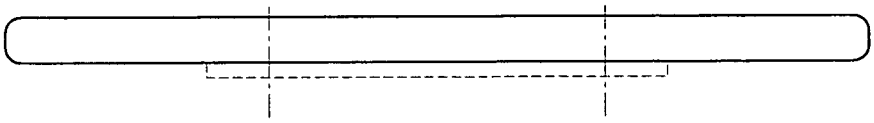
Figure 15A:
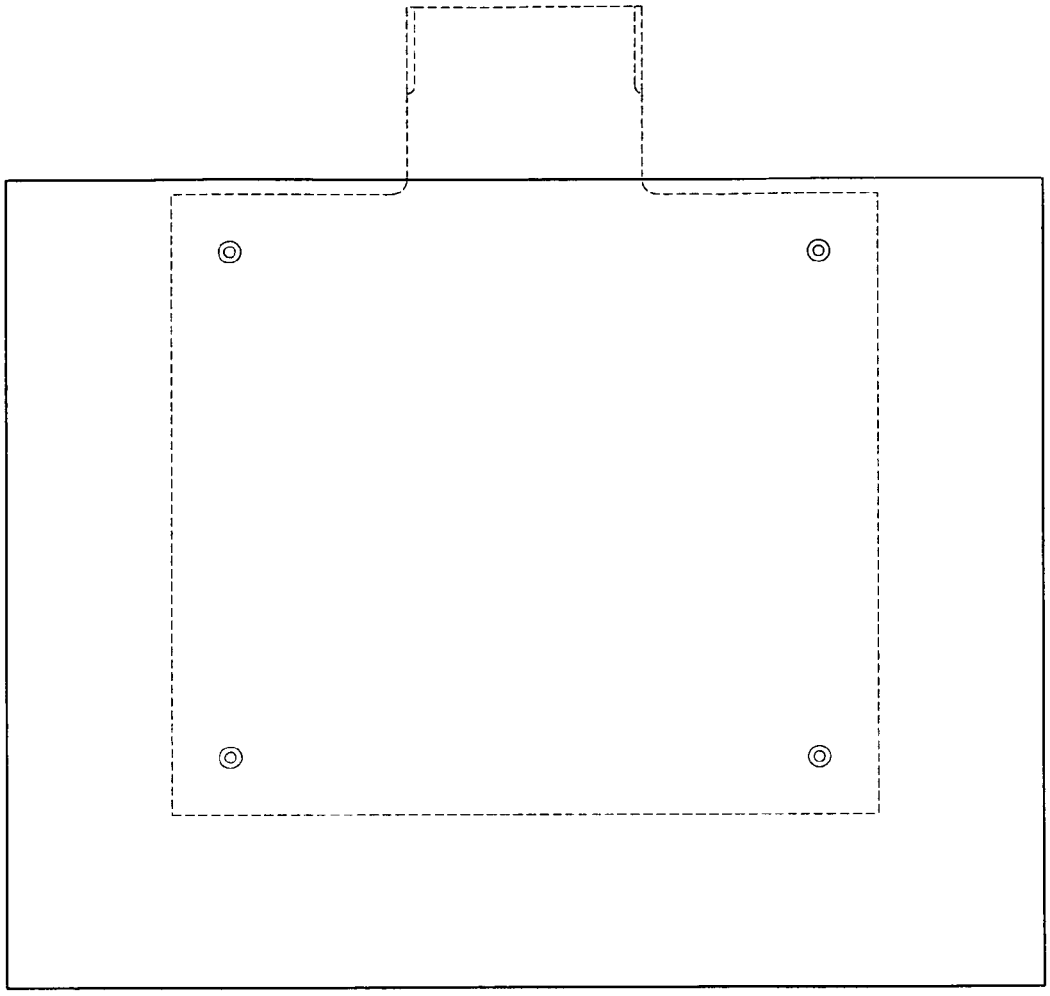
FIGS. 15A-15B illustrate bottom and front view of an exemplary pallet for 12 inch numbers.
Figure 15B:
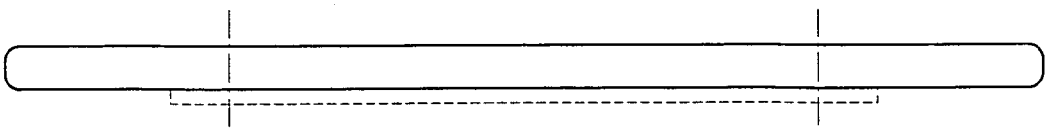
Figure 17A:
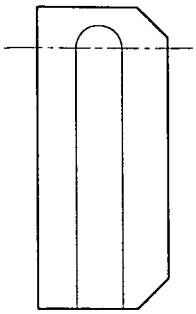
FIGS. 17A-17D illustrate elevation views of an exemplary pallet for hats.
Figure 17B:
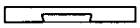
Figure 17C:
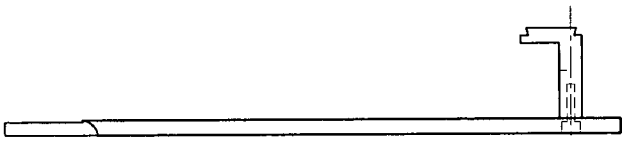
Figure 17D:
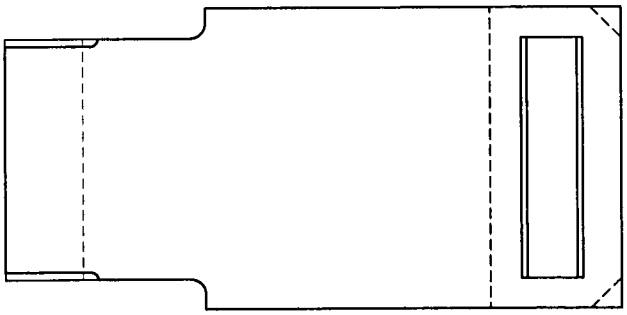
Figure 18A:
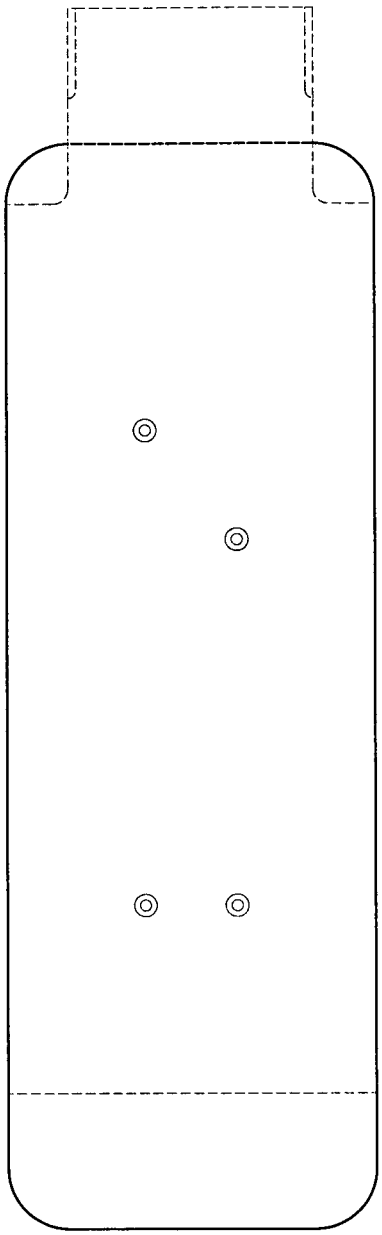
FIGS. 18A-18B illustrate bottom and front views of an exemplary pallet for pants.
Figure 18B:
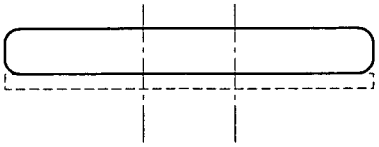
Figure 19A:
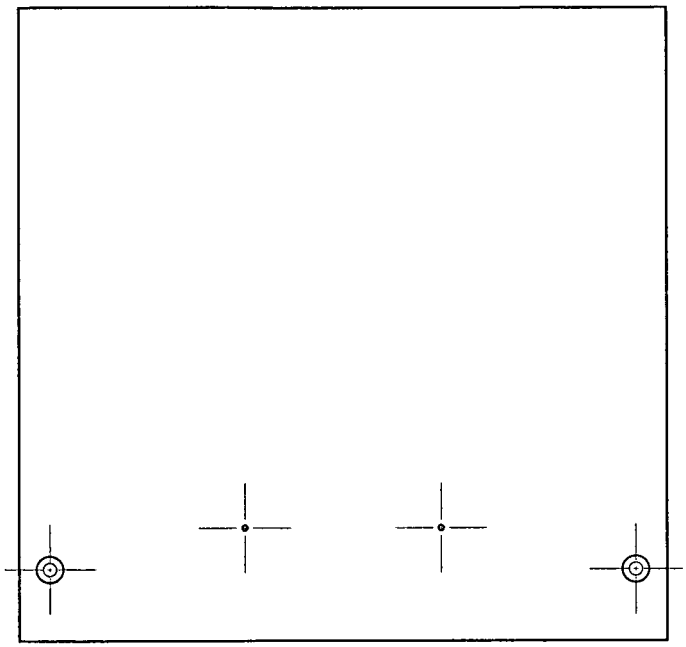
FIGS. 19A-19B illustrate bottom and front views of an exemplary pallet for screen burning.
Figure 19B:
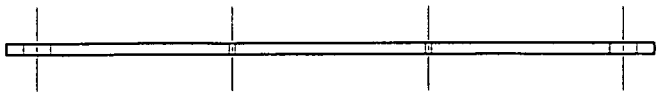

Referring to FIG. 1, the interchangeable pallet design (e.g., reference numbers 3-7 and FIG. 2 reference number 0) allow an operator to easily and quickly change the pallet to accommodate a desired object for printing. FIGS. 14A-14B illustrate an example of an interchangeable pallet for shirts, which together create the interchangeable pallet unit (see, e.g., FIG. 2 reference number 0). The interchangeable pallet unit slides into the interchangeable pallet mounting bar (see, e.g., FIG. 1 reference number 4 and FIG. 2 reference number 7). Once the interchangeable pallet unit (see, e.g., FIG. 2 reference number 0) slides into the bar (FIG. 2 reference number 7), an operator can tighten a pallet lock down element (see, e.g., FIG. 1, reference E) to lock the interchangeable pallet unit (see, e.g., FIG. 2 reference number 0) into a precise lock down position in preparation to receive a garment for screen printing.

The interchangeable pallets can be manufactured to any size or shape, depending upon various requirements for different print jobs. Common sizes interchangeable pallets (see, e.g., FIG. 2 reference number 4) include: 14"×14", 10"×12", 14"×20", 6"×6", 4"×4", and 1"×3".

Embodiments of printing apparatus including the present invention can also easily accommodate and use the off contact adjustments found on a typical textile rotary press. In addition, a stabilizer adjustment knob (See, e.g., FIG. 1-F), provides an operator with the ability to easily adjust the off contact height of the press, accommodating any thickness of material.

Figure 3:
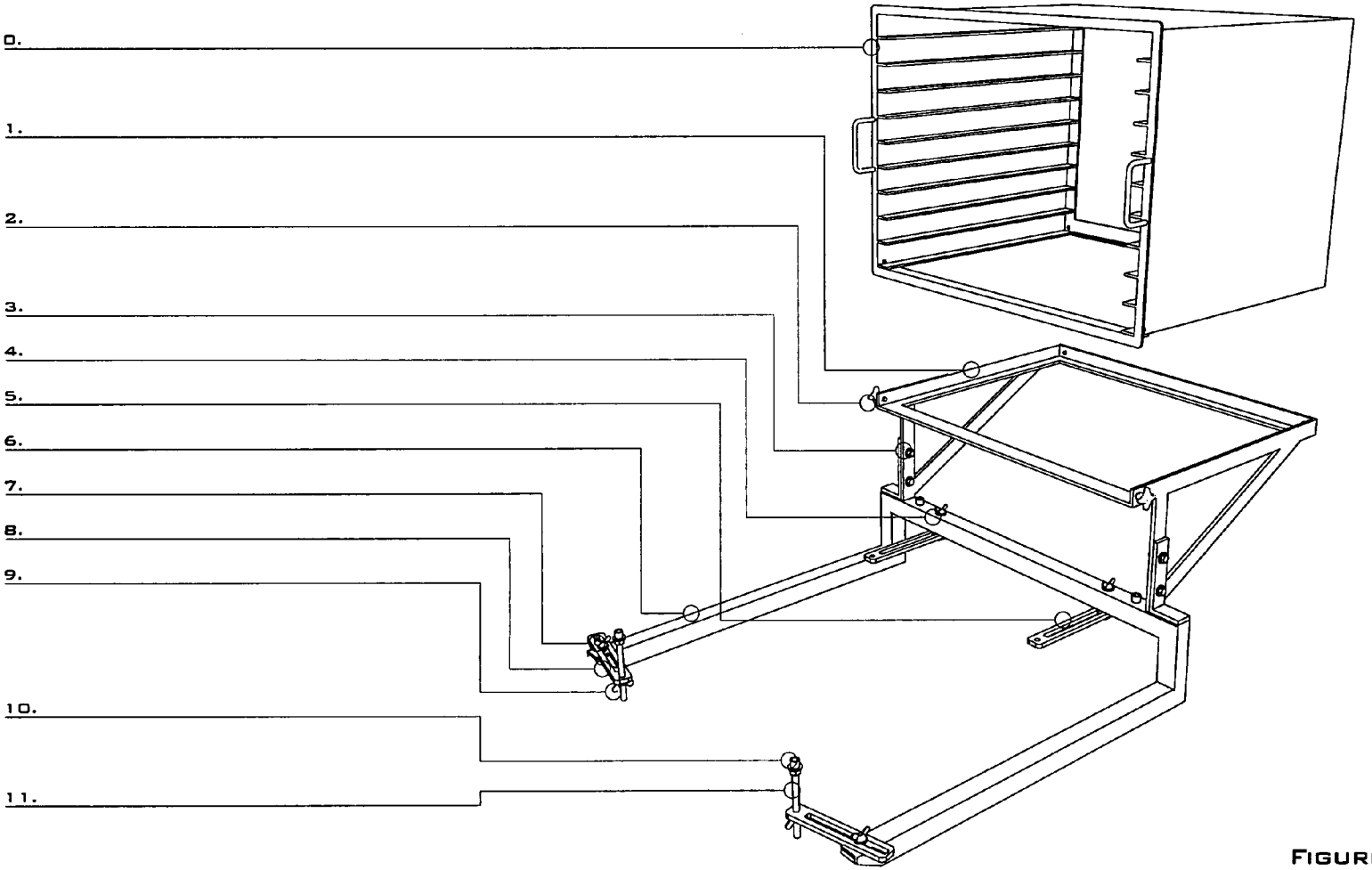
FIG. 3 illustrates an embodiment of a bar unit and a rack unit in accordance with aspects of the present invention.
Figure 13A:
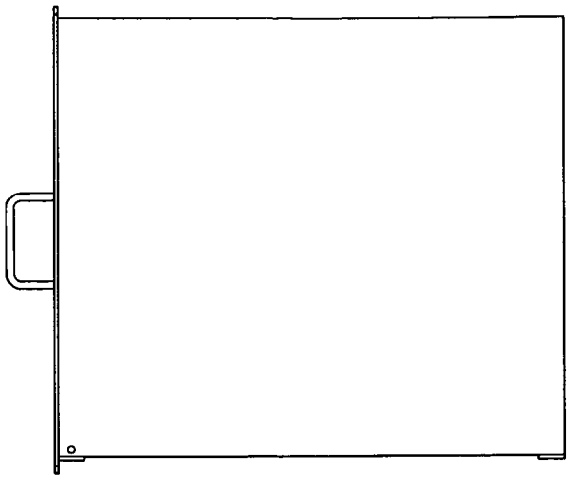
FIG. 13A is a top view of a cabinet portion of a rack unit of a rack unit FIG. 12A in accordance with the present invention.
Figure 13B:
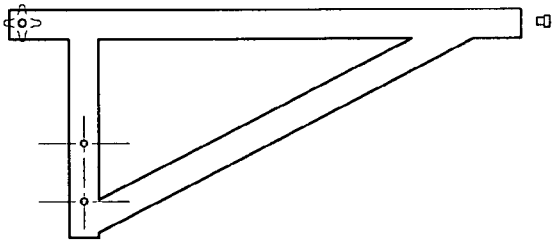
FIGS. 13B-13C illustrate a side view FIGS. 12B and 12C respectively.
Figure 13C:
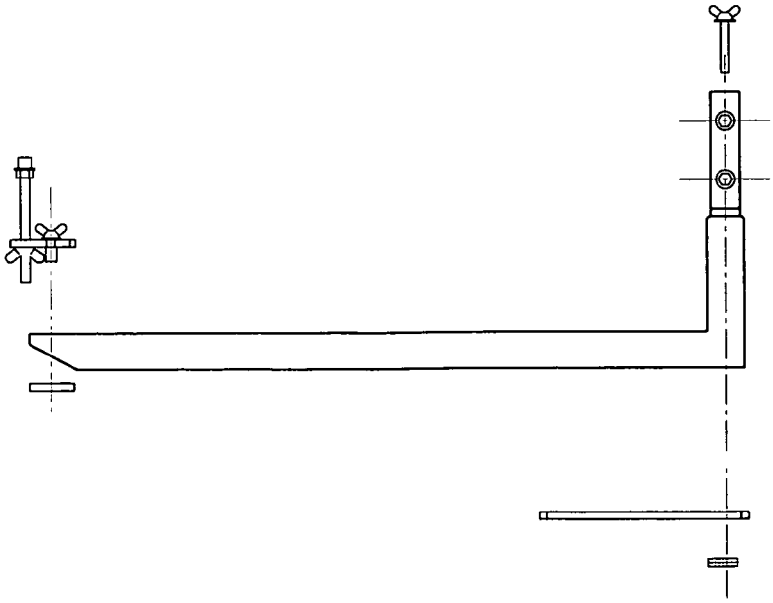

FIG. 3 illustrates an embodiment of a bar unit and a rack unit in accordance with aspects of the present invention. In FIG. 3, the arm unit (see, e.g., FIG. 3 reference number 6 and FIGS. 12 and 13) is designed to lock-in and hold the desired size screen (see, e.g., FIGS. 38 and 39) into a precise printing location.

Figure 22:
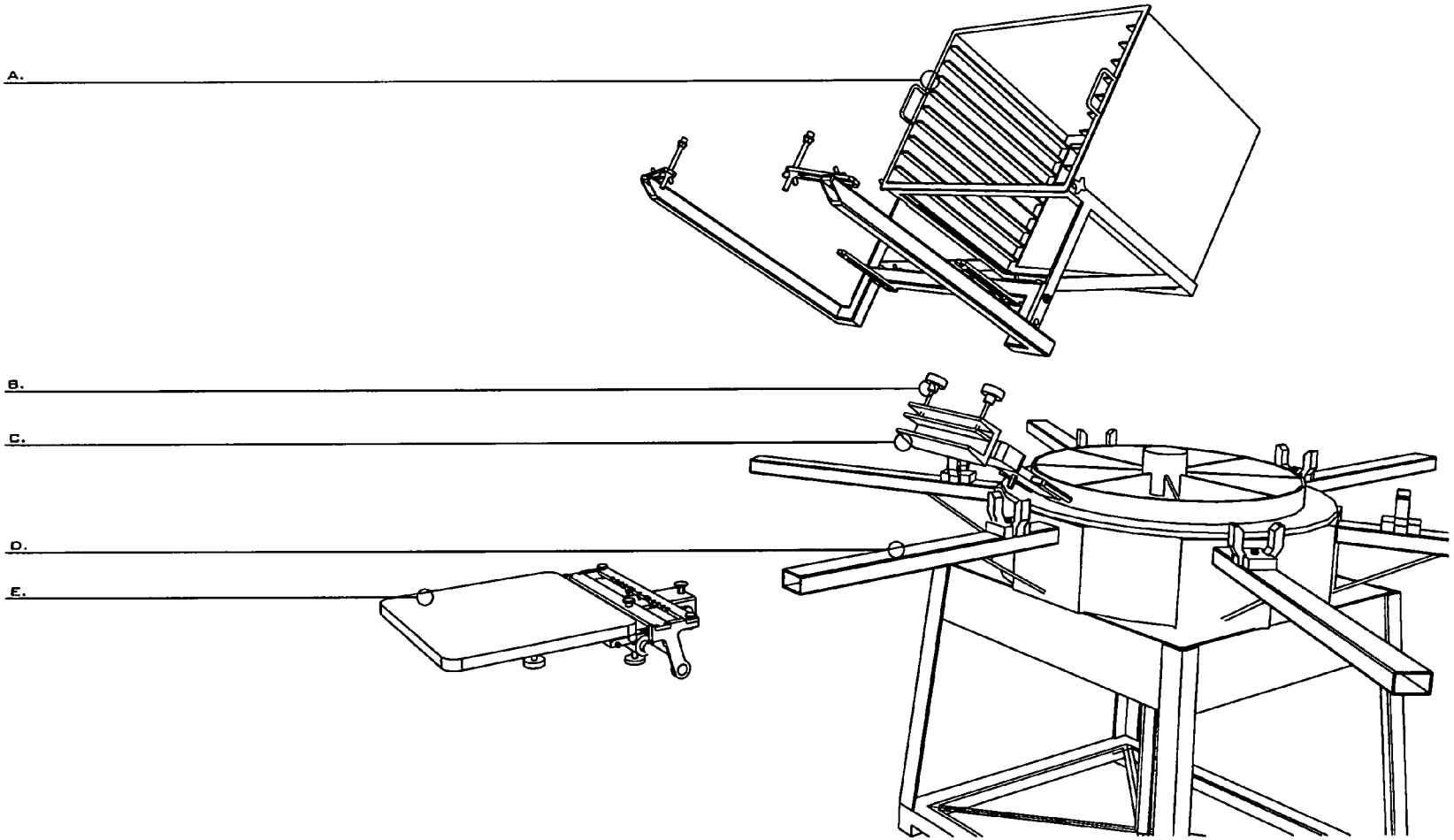
Figure 23:
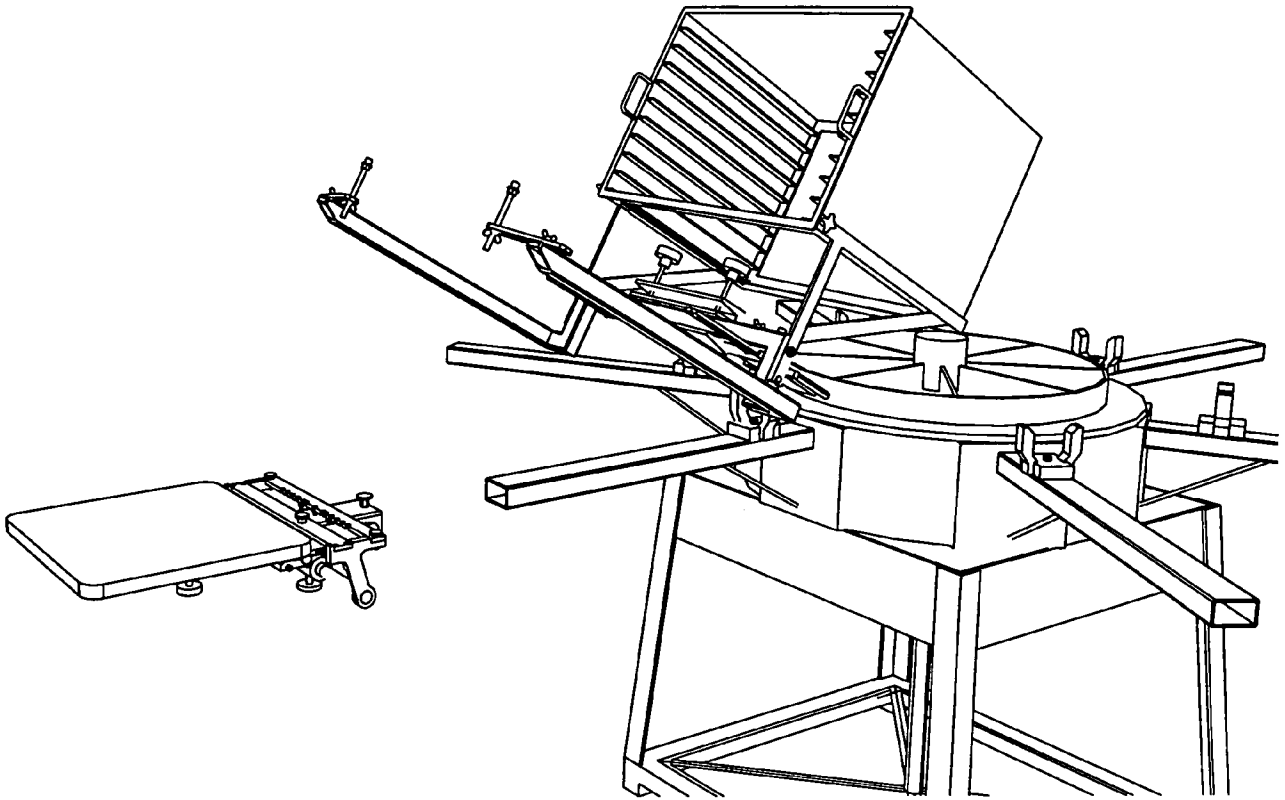
Figure 24:
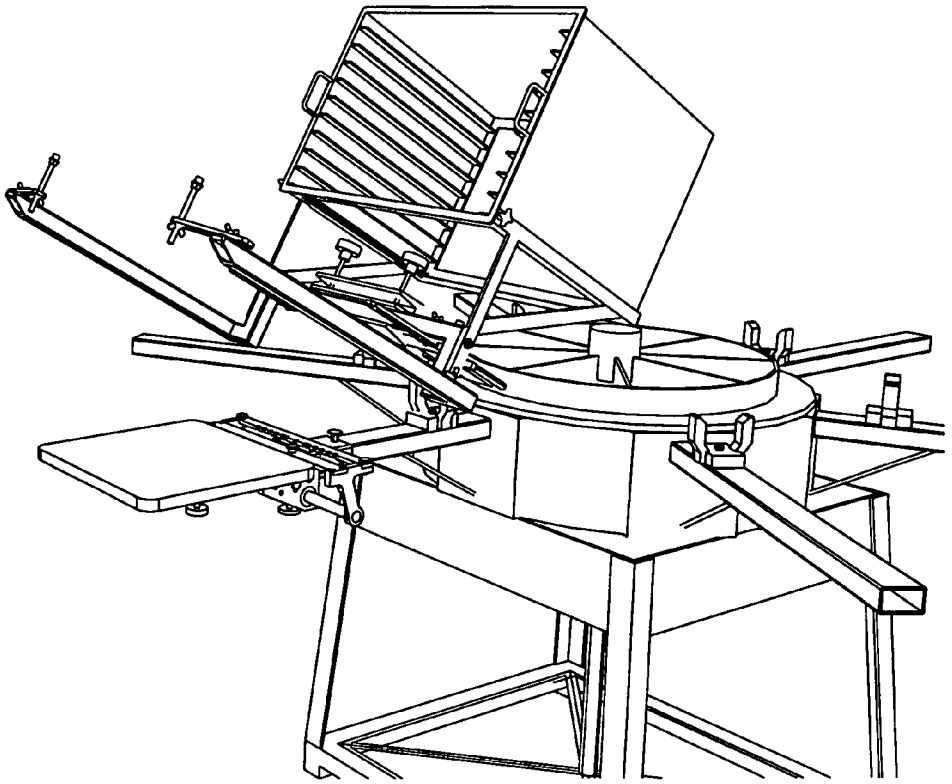
Figure 25:
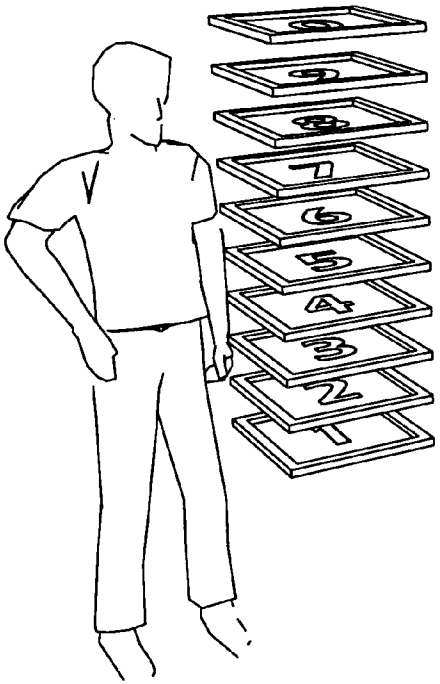
Figure 25:
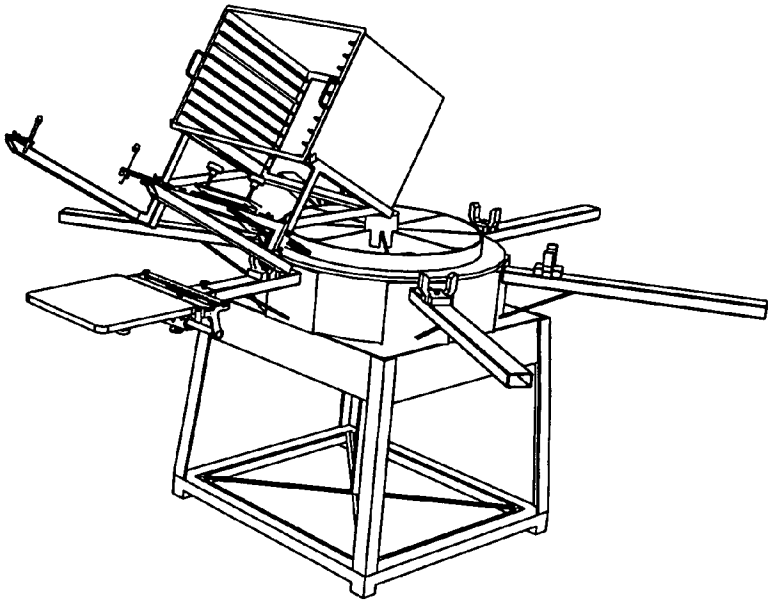
Figure 26:
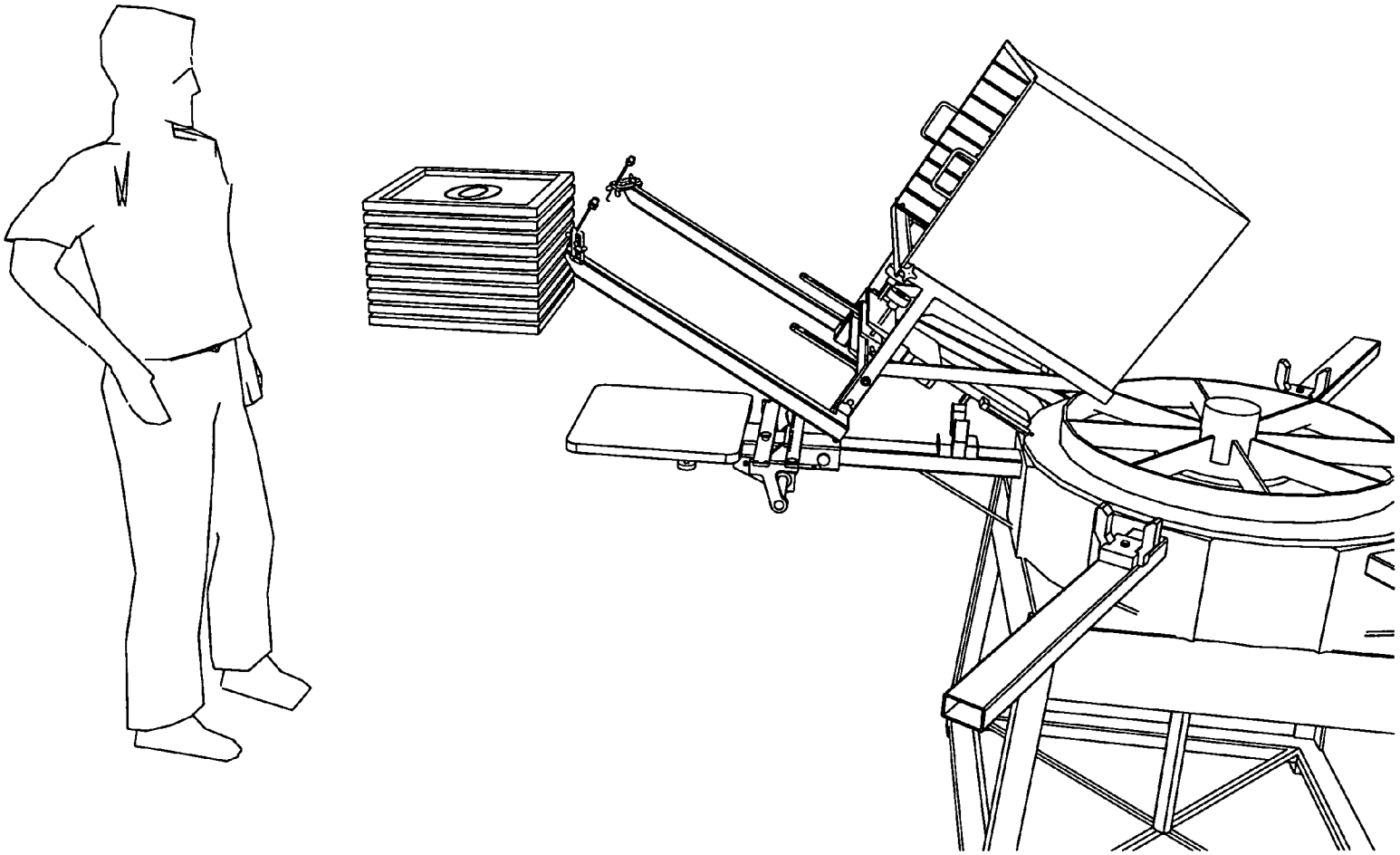
Figure 27:
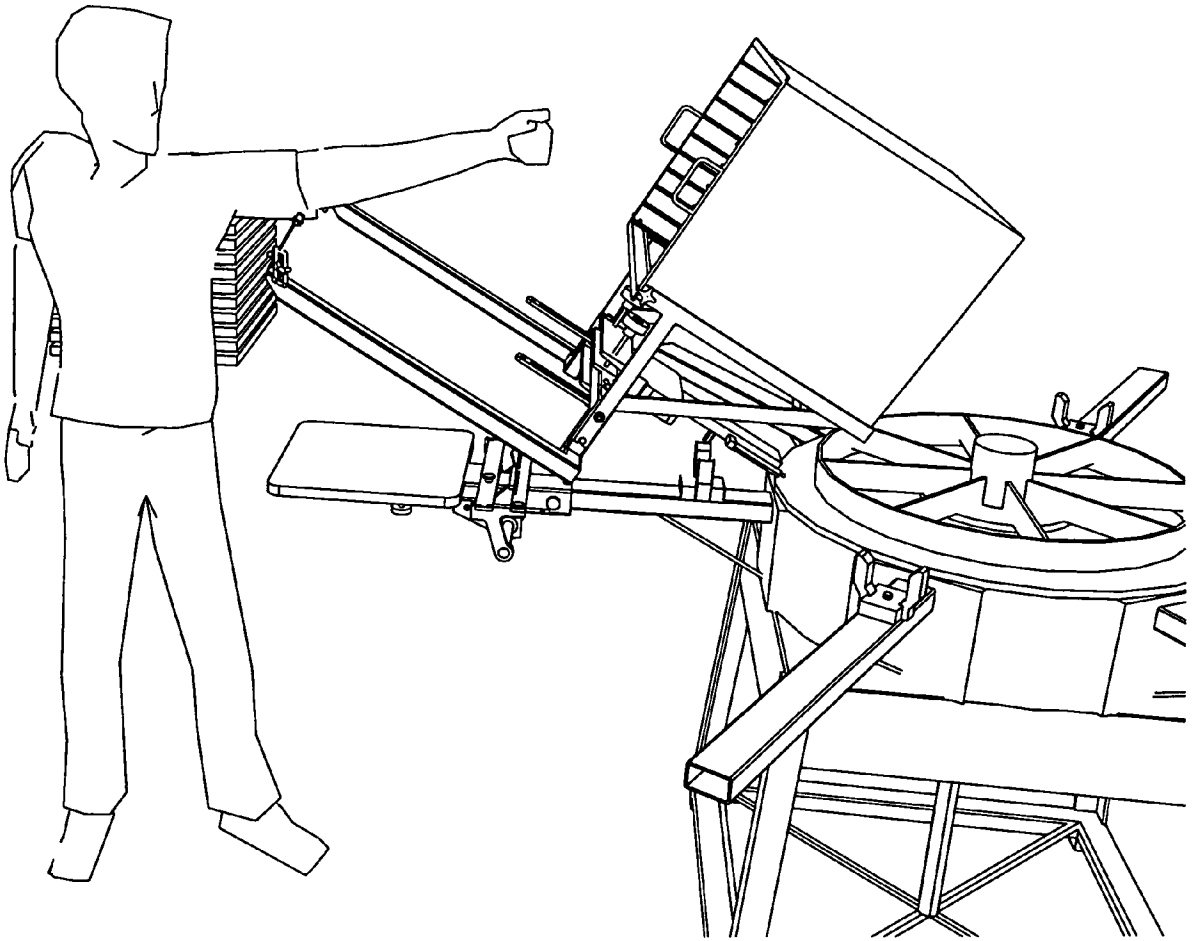
Figure 28:
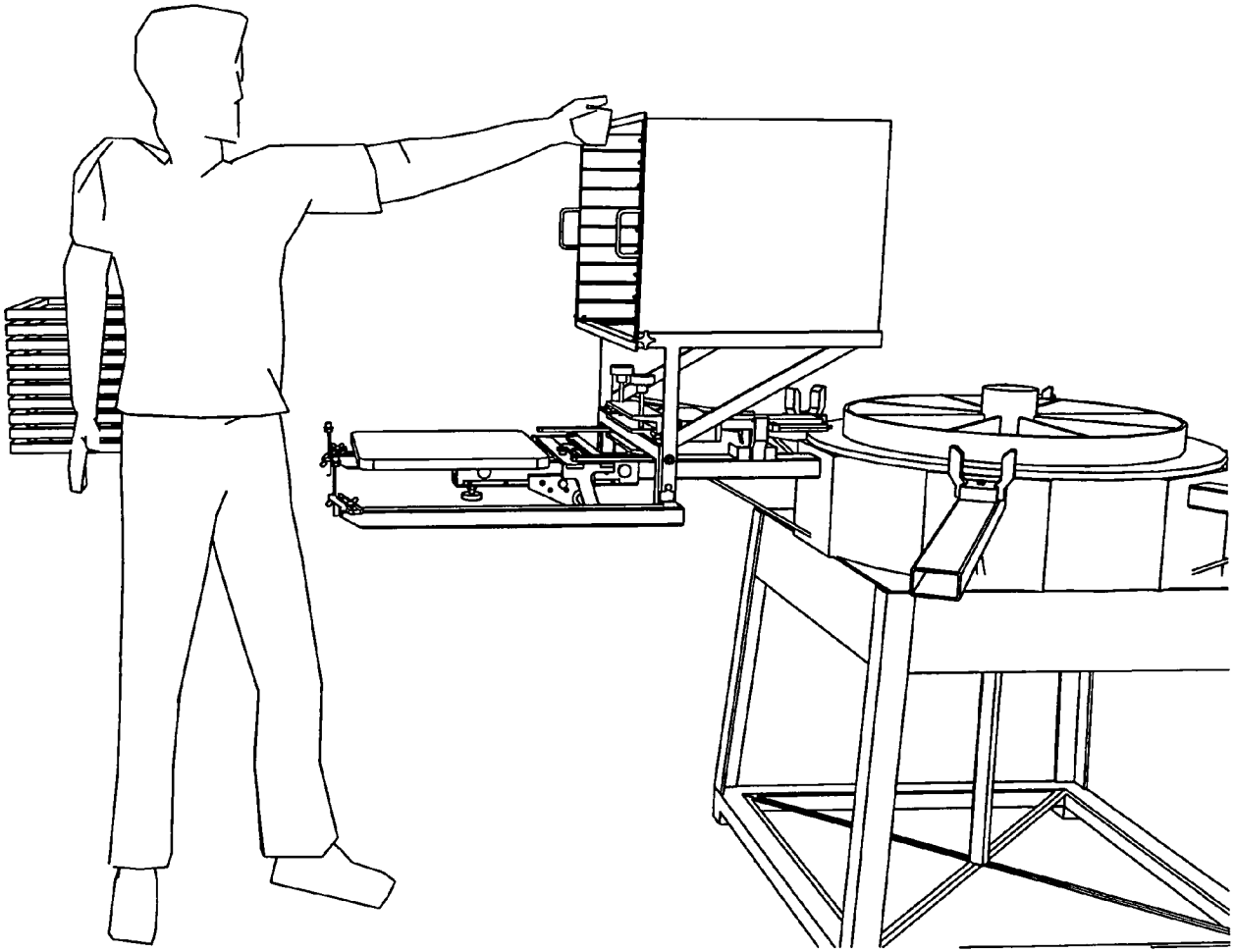

In FIG. 3 embodiment, the arm unit (see, e.g., FIG. 3 reference number 6) can be easily mounted and locked into place (see, e.g., FIGS. 22 and 23) on to a typical manual textile screen printing press print head (see, e.g., FIG. 22, C)(examples of such presses could include, but are not limited to Hopkins/BWM-Modesto Calif., Antec Screen Printing Equitment-Charlottesville, Va., Workhorse Products-Phoenix, Ariz., Riley Hopkins Promotions Limited-Gig Harbor Wash., and Hix Corporation-Pittsburg, Kans.).

The arm unit (see, e.g., Bar Unit FIG. 3 reference number 6) can be adjusted, centered, and locked into a desire placement by the lock down devise on a typical textile rotary press. (See, e.g., FIG. 22, B for an example of such a device).

The illustrative structure shown in FIG. 3 further depicts an embodiment of a rack unit (e.g., FIG. 3 reference number 0 and FIGS. 12 and 13) which attaches to the support frame bracket (see, e.g., FIG. 3 reference number 1) through the use of the storage unit lock-down knobs (see, e.g., FIG. 3 reference number 2 and FIG. 12B, reference #15), thus locking it into place. The support frame bracket (see, e.g., FIG. 3 reference number 1) attaches to the arm unit (see, e.g., FIG. 3 reference number 6) through the use of the Frame Bracket Fasteners (see, e.g., FIG. 3 reference number 3 and FIGS. 12 and 13), thereby locking it into place.

Figure 21:
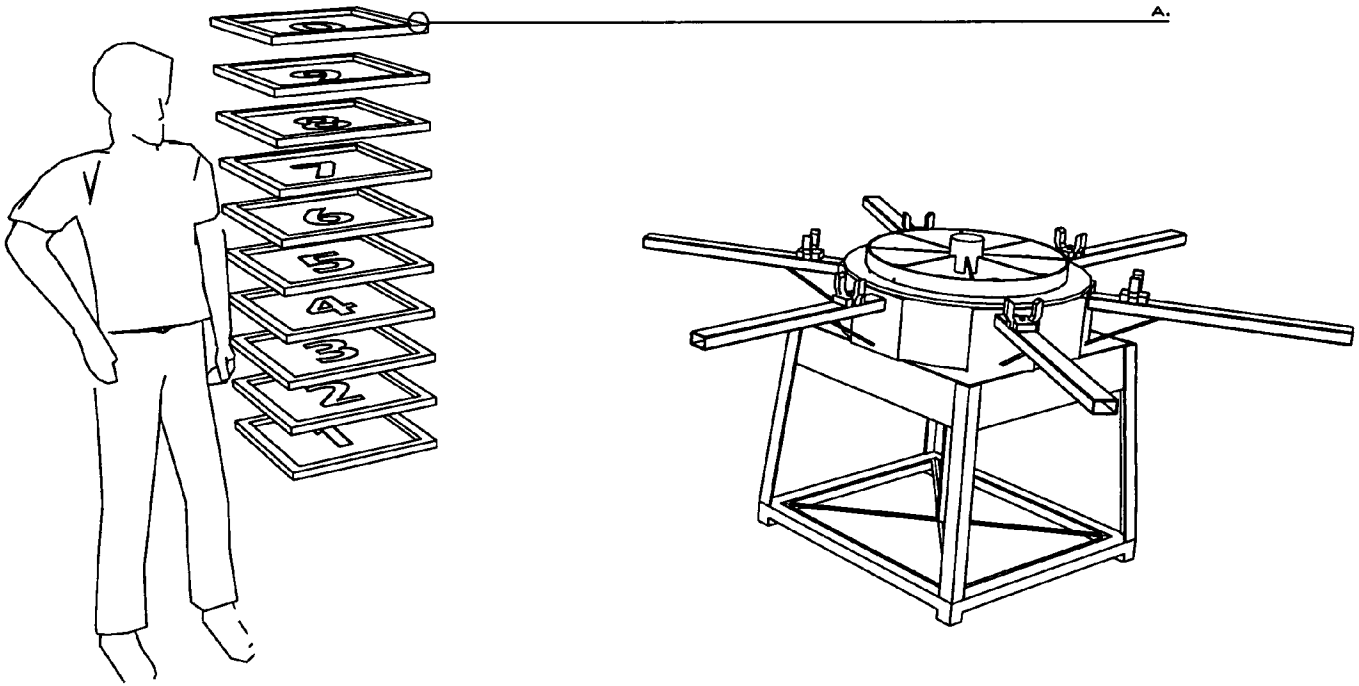
FIGS. 21-48 depict segments of an animation sequence illustrating operation of an apparatus in accordance with aspects of the present invention.
Figure 29:
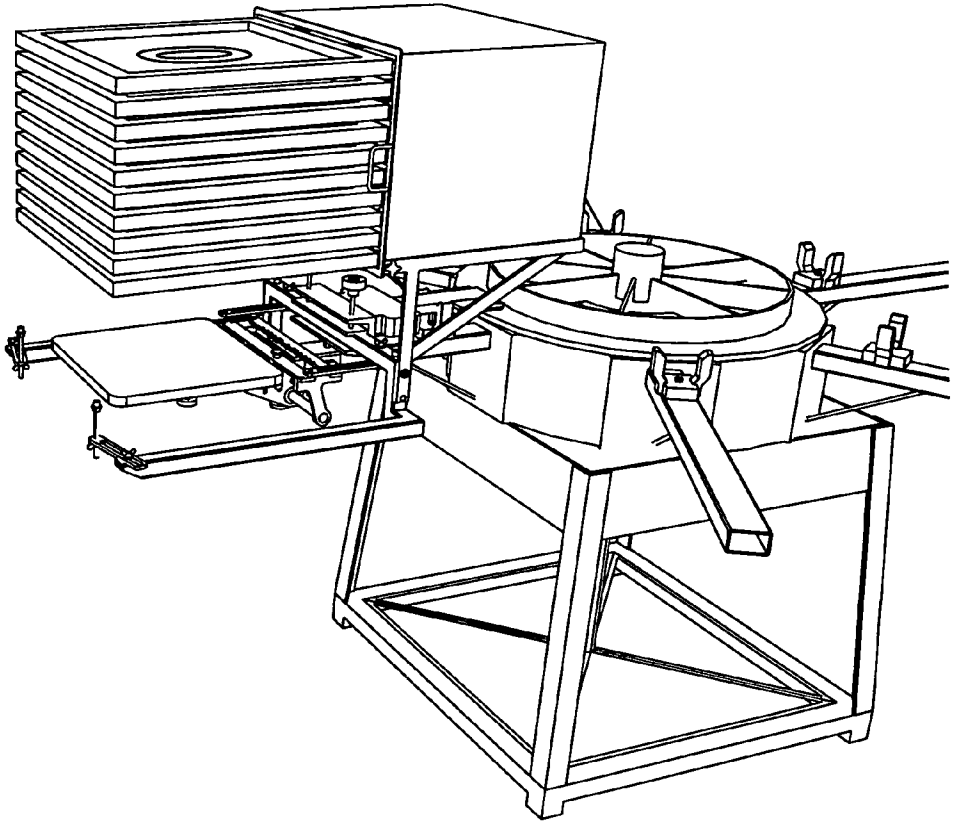
Figure 29:
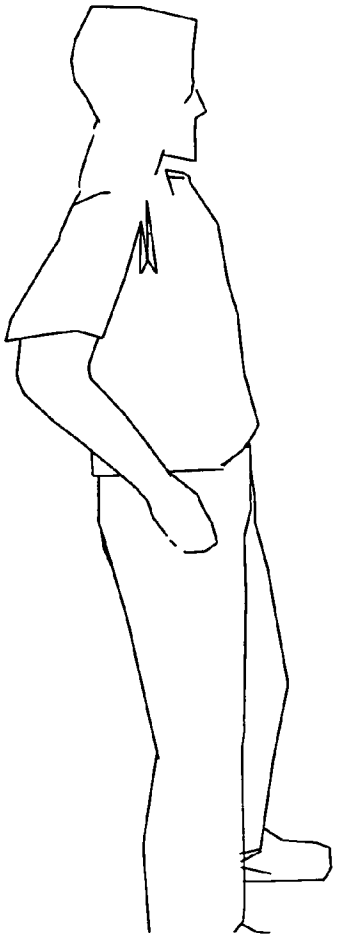
Figure 30:
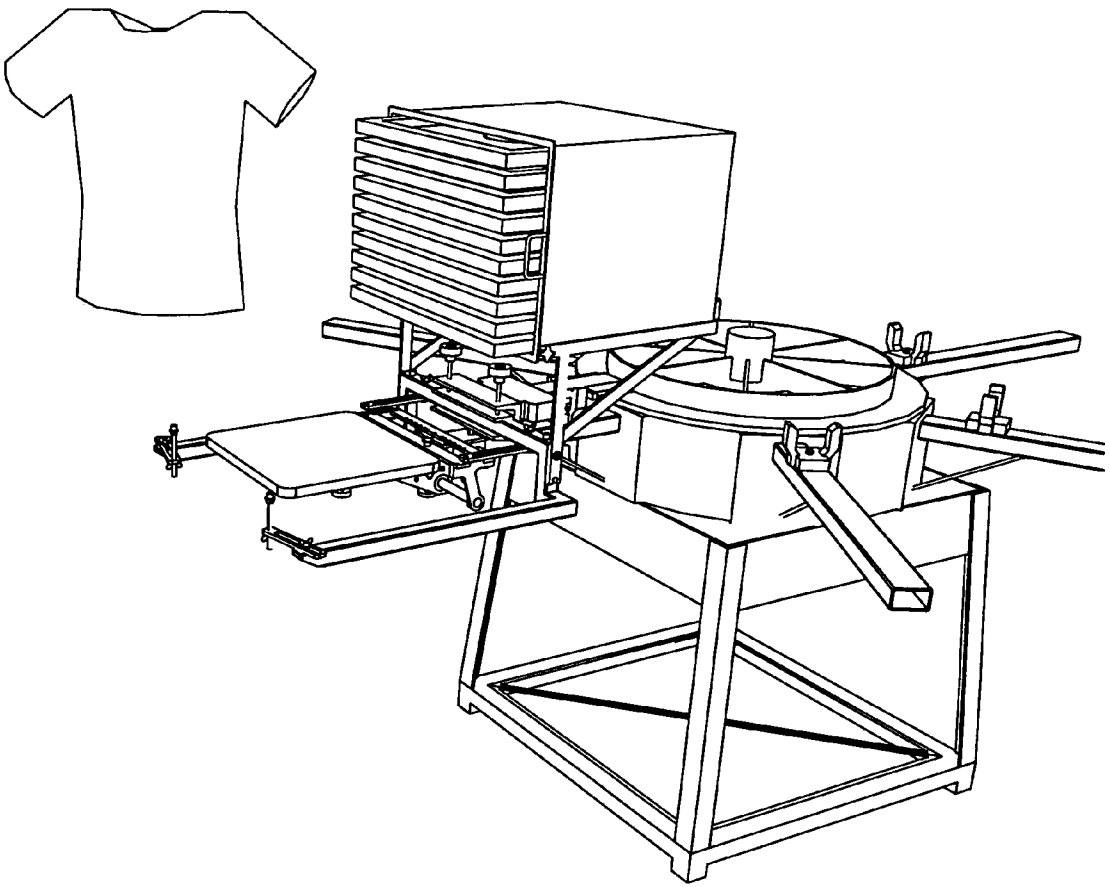
Figure 30:
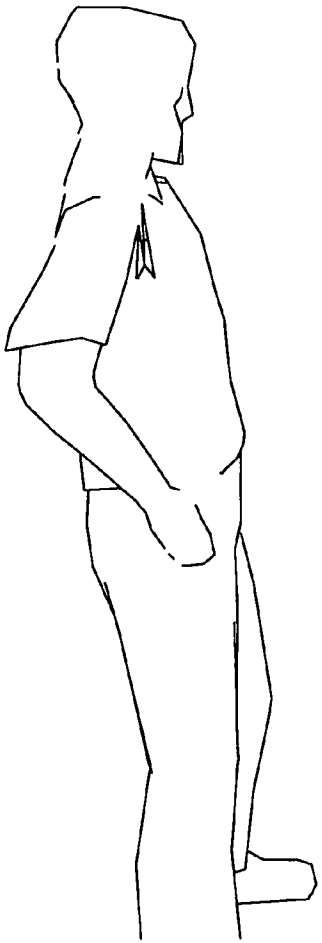
Figure 31:
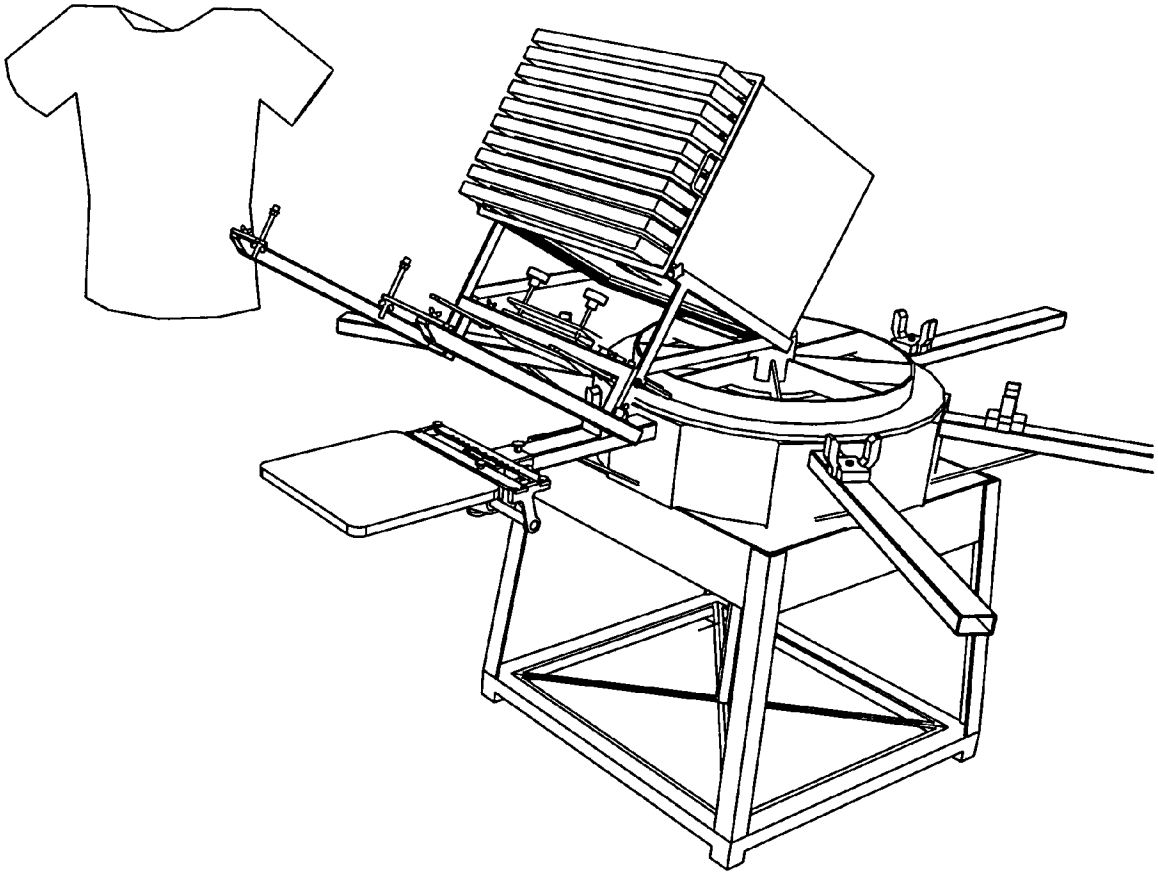
Figure 31:
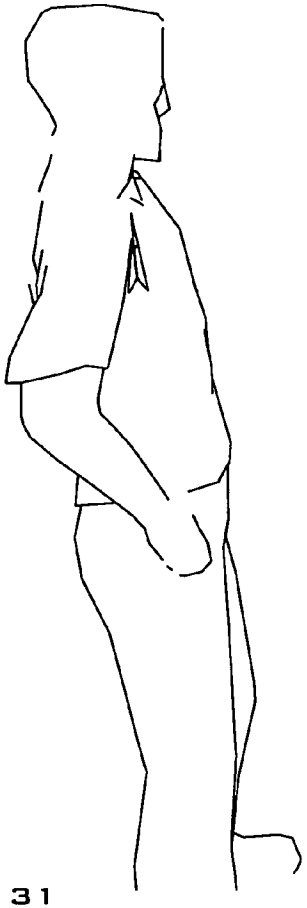
Figure 32:
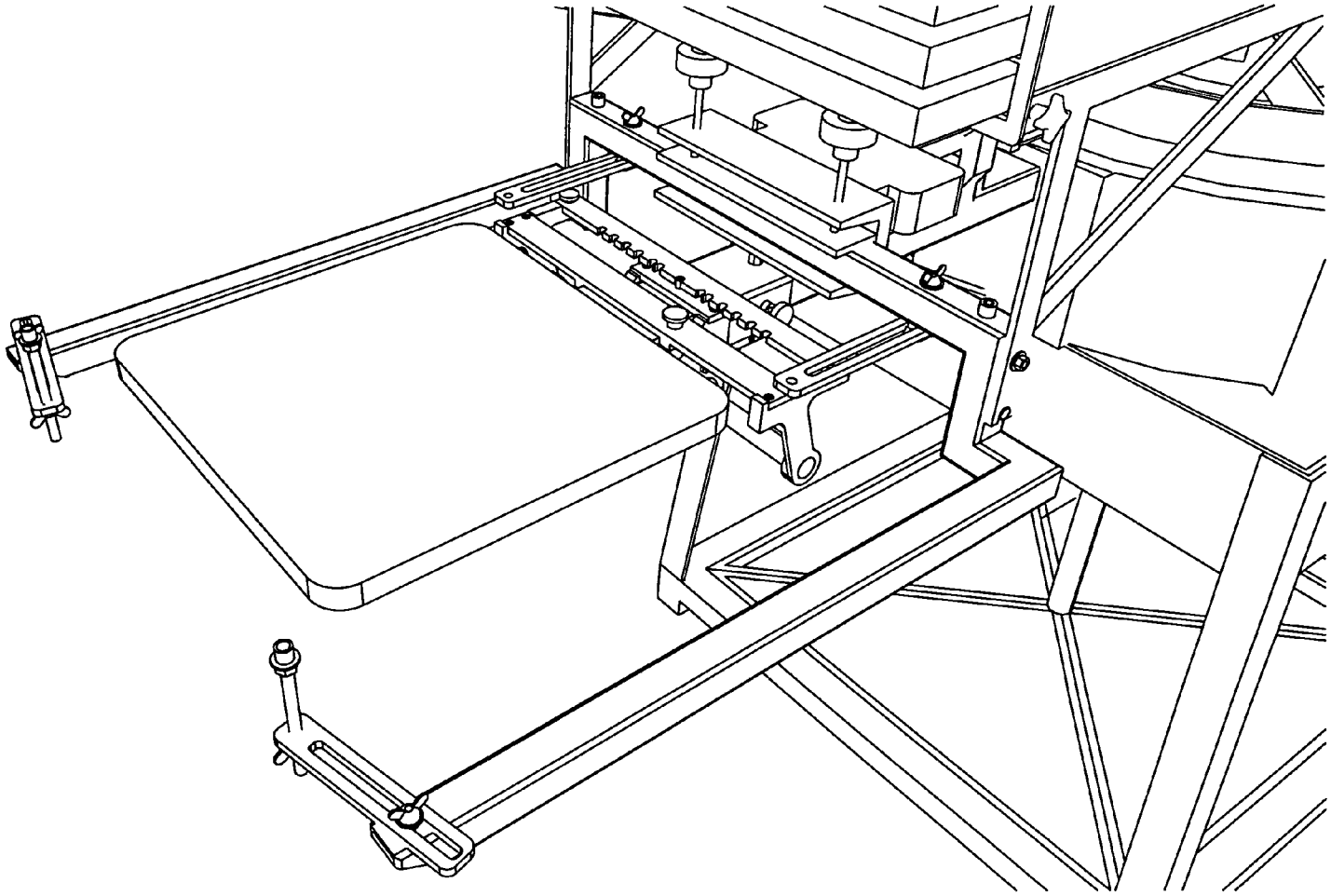
Figure 33:
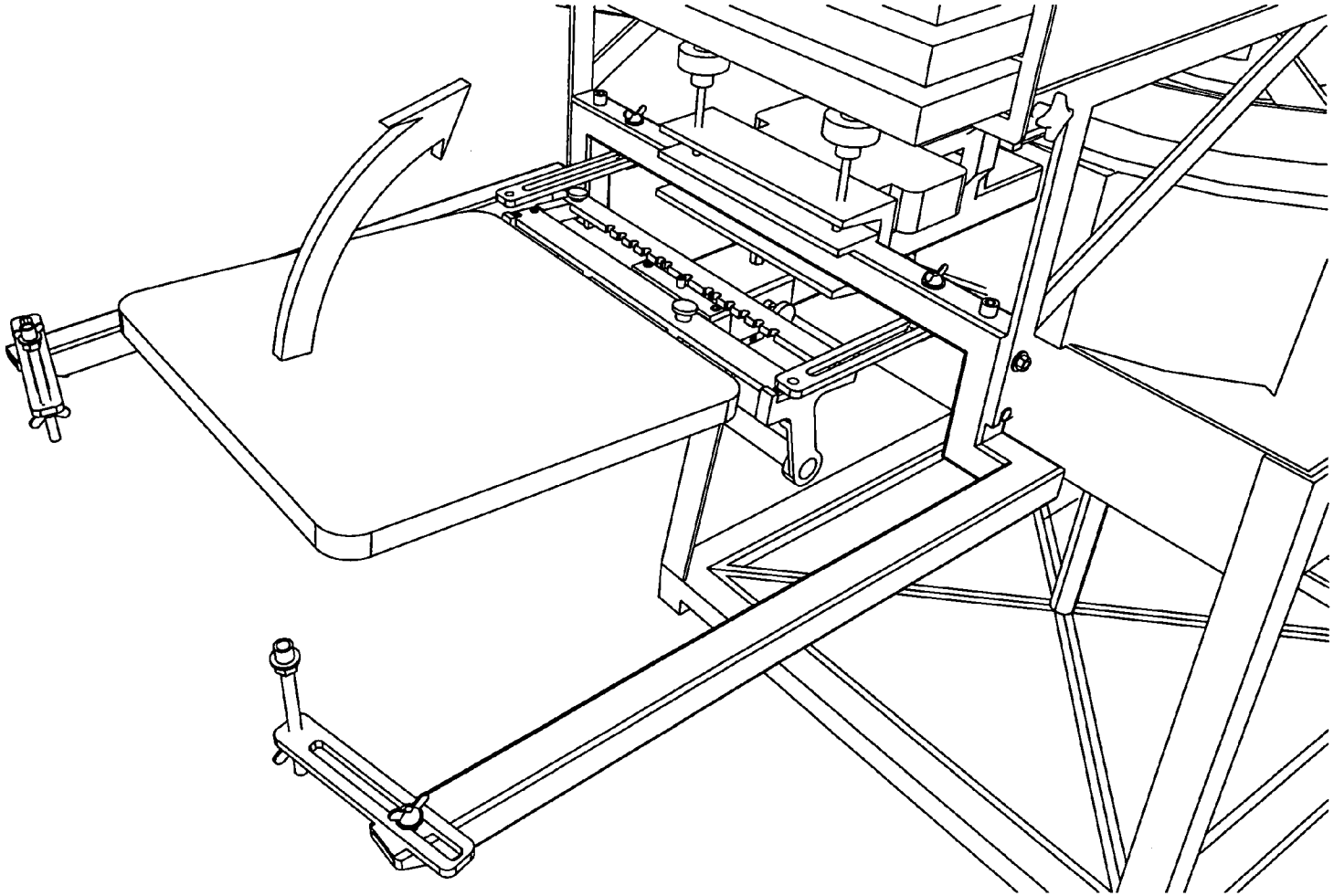
Figure 34:
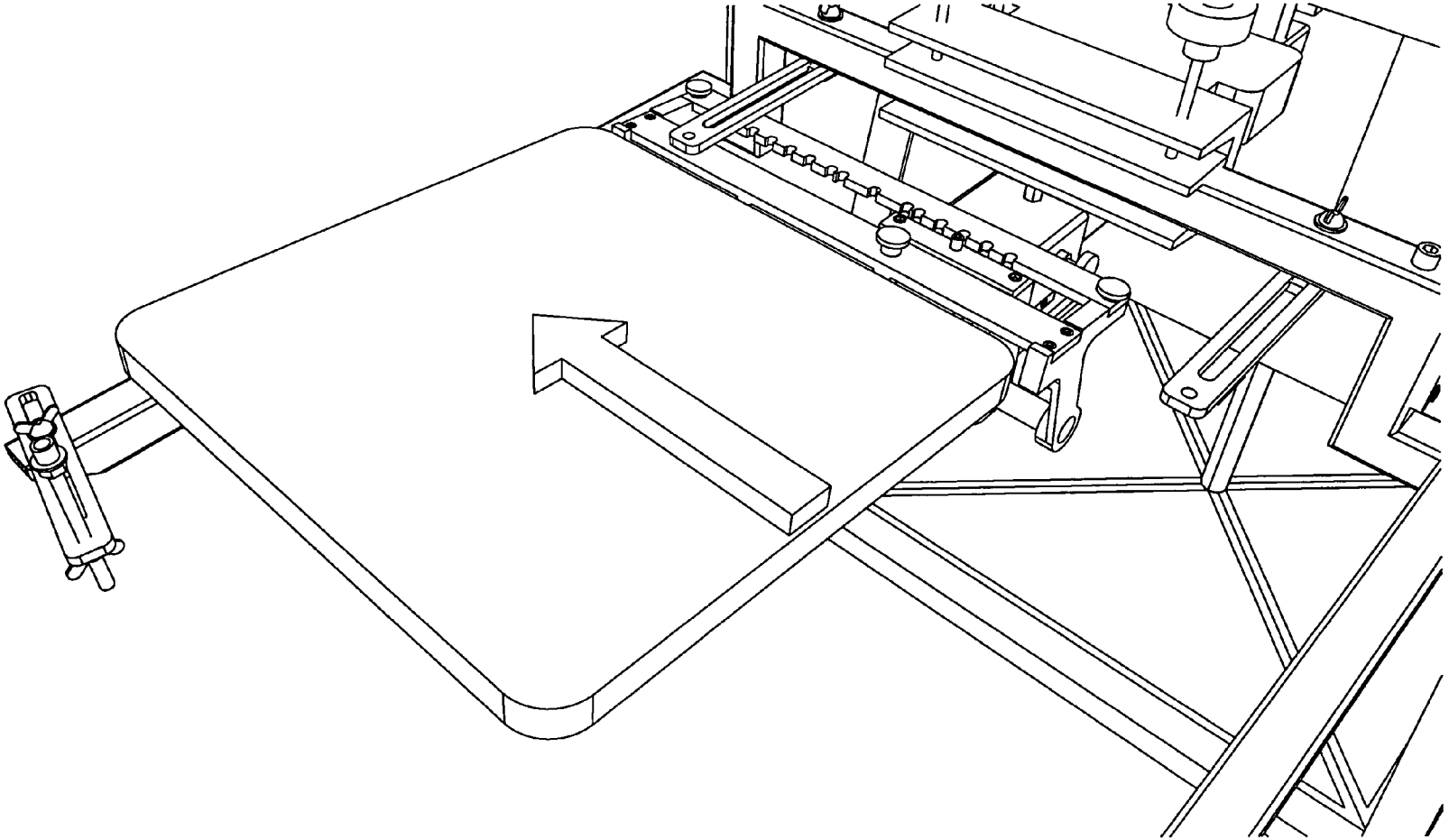

In the FIG. 3 example, the screen storage unit or rack unit can accommodate up to 10 screens (see, e.g., FIGS. 29 and 30). The design is not limited to accommodating more or less said screens as required. The number and size of printing screens (see, e.g., FIG. 21) will vary, depending upon the size of the graphics required for printing.

Figure 20:
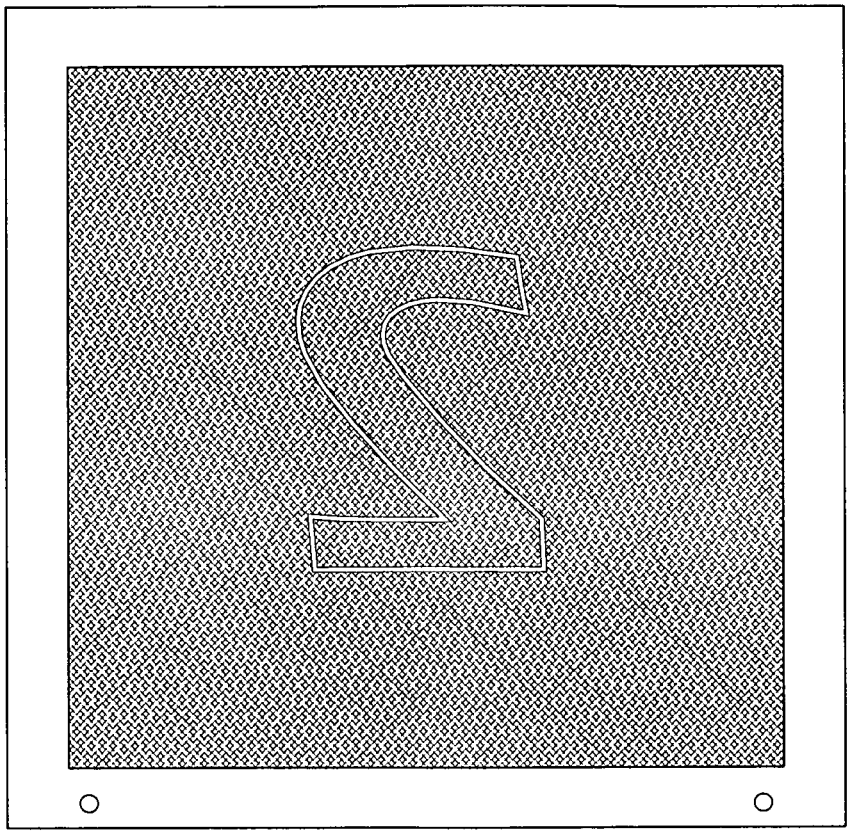
FIG. 20 is an exemplary print screen that can be used in accordance with the present invention.

The FIG. 3 embodiment also includes the screen locator pins (see, e.g., FIG. 3 reference number 10), which allow the arm unit (see, e.g., FIG. 3 reference number 6 and FIGS. 12 and 13, reference #16) to be able to hold the screen (see, e.g., FIG. 21) in a precise position in preparation for screen printing. In this example, the bottom of the screens have precise pre-drilled holes, such as the holes at the corners of the lower frame of the screen in FIG. 20, that will allow the screen to drop onto the locator pins (see, e.g., FIG. 3 reference number 10) to provide a precise lock-down position.

Figure 39:
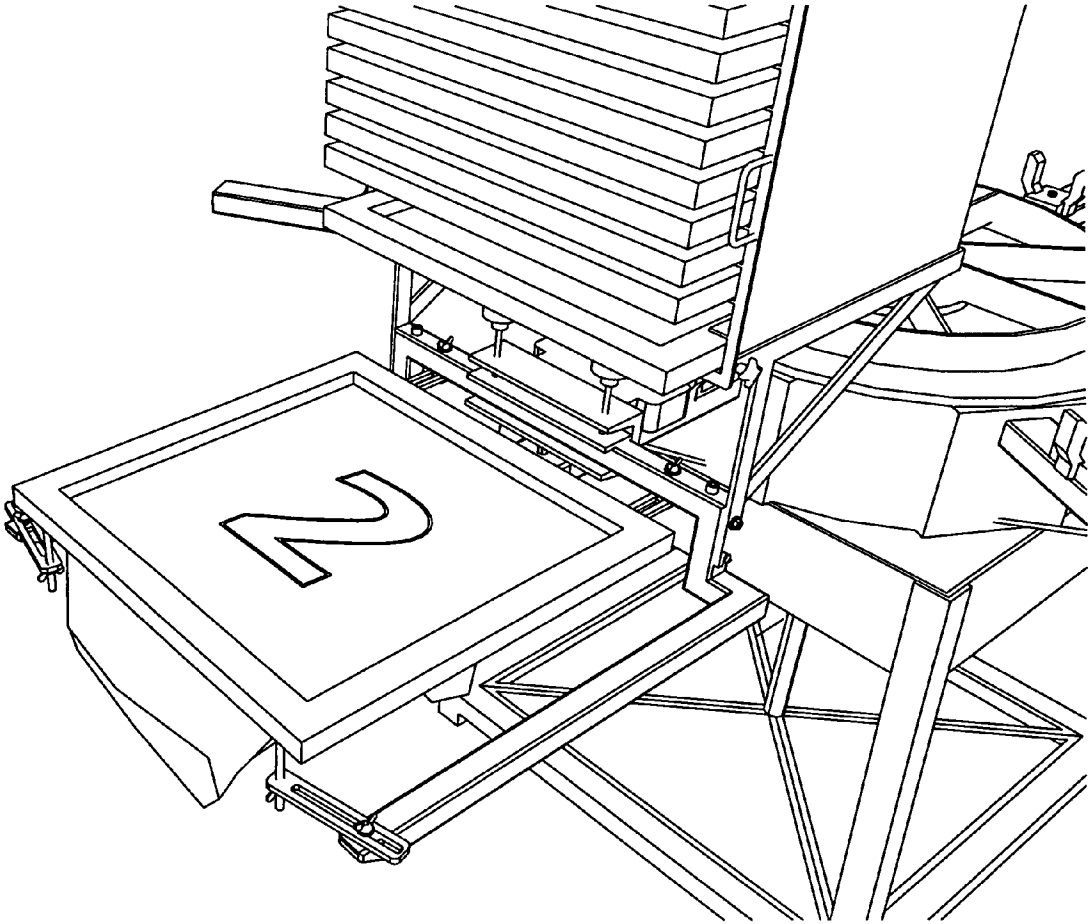

The FIG. 3 embodiment also includes an off contact adjustment rod (see, e.g., FIG. 3 reference number 11) which will allow the printing screens (see, e.g., FIG. 20) to move up or down to the desire height above the interchangeable pallet (see, e.g., FIG. 2 reference number 4 and FIG. 39). The off contact adjustment rods (see, e.g., FIG. 3 reference number 11 and FIGS. 12 and 13 reference #16) will be able to be locked into place by fastening them with the off contact adjustment rod lock-down knobs (see, e.g., FIG. 3 reference number 9 and FIGS. 12 and 13 at reference #16).

In addition, the illustrative structure depicted in FIG. 3 includes front adjustment bars (see, e.g., Bar Unit FIG. 3 reference number 8 and FIG. 12D at reference #16) which will allow the printing screens (see, e.g., FIG. 20) to be adjusted freely on a plane parallel to that of the interchangeable pallet (see, e.g., FIG. 1 reference number 3) to a desired precise lock-down position (see, e.g., FIG. 39). These adjustment bars (see, e.g., FIG. 3 reference number 8) are able to pivot in said manner due to their rotational and expandable ability (see, e.g., FIG. 3 reference number 8 and FIG. 12D at reference #16). This feature allows the bars to be locked-down when needed by fastening the front adjustment bar lock down knobs. (see, e.g., FIG. 3 reference number 7).

The FIG. 3 embodiment also includes a rear off contact adjustment bar (see, e.g., FIG. 3 reference number 5, and FIGS. 12 and 13 at reference #18) which allows printing screens (see, e.g., FIG. 20) to sit upon and acquire a position parallel with the interchangeable pallet (see, e.g., FIG. 1 reference number 3). In this example, this can be accomplished using the front and rear off contact adjustment rods (see, e.g., FIG. 3 reference numbers 11 and 5) working in conjunction with one another to acquire a level position in preparation for screen printing (see, e.g., FIG. 39). The rear off contact adjustment bars (see, e.g., FIG. 3 reference number 5) can be locked-down into a precise position by fastening the rear off contact adjustment bar lock-down knobs (see, e.g., FIG. 3 reference number 4 and FIG. 12C at reference #18).

It will be apparent to those skilled in the art that various modifications and variations can be made in the of embodiments of the invention without departing from the spirit or scope of the invention. Thus, it is intended that embodiments of the invention cover the modifications and variations of this invention provided they come within the scope of the appended claims and their equivalents.

What is claimed is:

1. A rotary printing apparatus comprising:

a plurality of printing stations; and an interchangeable pallet unit having a longitudinal axis and slidably adjustable along a rotary screen printing arm rotatable to the plurality of printing stations including:

a pallet;

a mounting mechanism positioned and configured to operatively connect the interchangeable pallet unit to a mounting arm operatively connected to the rotary screen printing arm, and a movement mechanism operatively connected to the mounting mechanism and to the pallet so as to allow movement of the pallet in directions transverse to the longitudinal axis and in directions along the longitudinal axis, wherein the pallet is slidably adjustable along the longitudinal axis;

an indexing mechanism operatively connected to the mounting arm and positioned so as to permit indexed movement of the pallet in directions transverse to the longitudinal axis and relative to the mounting arm; and an adjustable bar unit operatively connectable to the mounting arm configured to receive a printing screen and hold the printing screen in a printing location.

2. A rotary printing apparatus according to claim 1, further including a tilting mechanism operatively connected to the interchangeable pallet unit and to the indexing mechanism so as to allow the interchangeable pallet to move relative to the indexing mechanism.

3. A rotary printing apparatus according to claim 1, wherein the indexing mechanism including an index point and a series of index stops.

4. A rotary printing apparatus according to claim 1, further comprising a rack unit operatively connected to the adjustable bar unit and including a plurality of slots for storing a plurality of printing screens.

5. A printing apparatus according to claim 1 wherein the adjustable bar unit includes an off contact adjustment rod, one or more front adjustment bars, and a rear off contact adjustment bar.

6. A method of printing on a medium using an apparatus operatively connectable to a mounting arm, comprising:

positioning an interchangeable pallet unit having a longitudinal axis on the mounting arm operatively connected to a rotary screen printing arm, wherein the rotary screen printing arm is operatively connected to a rotary printing apparatus including a plurality of printing stations, wherein the rotary screen printing arm is rotatable to the plurality of printing stations;

positioning the interchangeable pallet using an indexing mechanism operatively connected to the mounting arm, at a first desired index stop by moving the interchangeable pallet in a first direction transverse to the longitudinal axis and relative to the mounting arm;

slidably adjusting the interchangeable pallet along the longitudinal axis to a first desired position;

positioning an adjustable bar unit to receive a printing screen, the adjustable bar unit configured to hold the printing screen in a printing location;

using the printing screen to print;

positioning the interchangeable pallet using an indexing mechanism operatively connected to the mounting arm, at a second desired index stop by moving the interchangeable pallet in a second direction transverse to the longitudinal axis and relative to the mounting arm;

slidably adjusting the interchangeable pallet along the longitudinal axis to a second desired position;

re-positioning the adjustable bar unit to receive the printing screen; and using the printing screen to print.

7. A method according to claim 6 wherein the adjustable bar unit includes an off contact adjustment rod, one or more front adjustment bars, and a rear off contact adjustment bar.

8. A printing apparatus operatively connectable to a mounting arm having a longitudinal axis and an axis transverse to the longitudinal axis, comprising:

a mounting apparatus configured to be fixedly connected to the mounting arm operatively connected to a rotary screen printing arm, wherein the rotary screen printing arm is operatively connected to a rotary printing apparatus including a plurality of printing stations, wherein the rotary screen printing arm is rotatable to the plurality of printing stations;

a pallet movably connected to the mounting apparatus so as to be movable in first and second directions along an axis parallel to the transverse axis and movable in first and second directions along an axis parallel to the longitudinal axis;

an index mechanism including a plurality of index stops respectively corresponding to a plurality index positions of the pallet, and being fixedly connected with respect to the mounting apparatus so as to selectively engage the pallet at a desired one of the index positions, wherein the plurality of index positions extend in directions parallel to the transverse axis; and an adjustable bar unit operatively connectable to the mounting arm configured to receive a printing screen and to hold the printing screen in a printing location.

9. A printing apparatus according to claim 8, wherein the mounting apparatus is configured to be removably connected to the mounting arm.

10. A printing apparatus according to claim 8, wherein the index mechanism is fixedly connected to the mounting apparatus.

11. A printing apparatus according to claim 8 wherein the adjustable bar unit includes an adjusting mechanism positioned to allow movement of the printing screen relative to the longitudinal axis and the transverse axis.

12. A printing apparatus according to claim 8, further comprising a rack unit operatively connected to the adjustable bar unit and including a plurality of slots for storing a plurality of printing screens.

13. A printing apparatus according to claim 8, wherein the adjustable bar unit includes an off contact adjustment rod, one or more front adjustment bars, and a rear off contact adjustment bar.

* * * * *